US007290387B2

(12) United States Patent
Yoshioka

(10) Patent No.: US 7,290,387 B2
(45) Date of Patent: Nov. 6, 2007

(54) CONTROL DEVICE OF INTERNAL COMBUSTION ENGINE

(75) Inventor: Mamoru Yoshioka, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 20 days.

(21) Appl. No.: 11/140,921

(22) Filed: Jun. 1, 2005

(65) Prior Publication Data

US 2005/0274105 A1 Dec. 15, 2005

(30) Foreign Application Priority Data

Jun. 9, 2004 (JP) ..... 2004-170936

(51) Int. Cl.
*F01N 3/00* (2006.01)

(52) U.S. Cl. ..... 60/285; 286/289; 286/290

(58) Field of Classification Search ..... 60/285, 60/286, 289, 290, 299
See application file for complete search history.

(56) References Cited

U.S. PATENT DOCUMENTS 5,784,880 A * 7/1998 Toshiro et al. ..... 60/277
5,941,211 A * 8/1999 Brehob et al. ..... 123/325
5,941,212 A * 8/1999 Murakami et al. ..... 123/325
6,212,884 B1 * 4/2001 Ohuchi et al. ..... 60/285
6,389,807 B1 * 5/2002 Suzuki et al. ..... 60/285
6,405,527 B2 * 6/2002 Suzuki et al. ..... 60/285
6,829,886 B2 * 12/2004 Nakata ..... 60/277
6,830,038 B2 * 12/2004 Yamashita et al. ..... 123/493
6,892,527 B2 * 5/2005 Ueda et al. ..... 60/277

FOREIGN PATENT DOCUMENTS

JP A-06-307271 11/1994
JP A-10-252532 9/1998

* cited by examiner

*Primary Examiner*—Thomas Denion
*Assistant Examiner*—Loren Edwards
(74) *Attorney, Agent, or Firm*—Oliff & Berridge, PLC

(57) ABSTRACT

A control device of an internal combustion engine suppressing catalyst deterioration by prohibiting fuel cuts, wherein the generation of odor from the catalyst after deceleration is suppressed. The control device is provided with a fuel cut executing device for stopping the supply of fuel to an internal combustion engine when a vehicle is in a decelerating state and a fuel cut prohibiting device for prohibiting a fuel cut when a temperature of a catalyst provided in an exhaust system is a predetermined temperature or more, wherein when a fuel cut is prohibited by the fuel cut prohibiting device when the vehicle decelerates in a predetermined period after an increased fuel operation is performed, the internal combustion engine is operated so that the combustion air-fuel ratio becomes lean in the decelerating state or in the decelerating state and its succeeding idling state.

7 Claims, 18 Drawing Sheets

CONTROL DEVICE OF INTERNAL COMBUSTION ENGINE

BACKGROUND OF THE INVENTION

1. Field of the Invention

The present invention relates to a control device of an internal combustion engine.

2. Description of the Related Art

In the past, there has been known a control device of an internal combustion engine mounted in a vehicle designed to execute a fuel cut for stopping the supply of fuel to the internal combustion engine in order to improve the mileage, etc. when it is judged that the supply of fuel to the internal combustion engine is not necessary when the vehicle is in a decelerating state (for example, in an engine braking state).

Further, among such control devices of internal combustion engines, there is one designed to prohibit execution of a fuel cut in a decelerating state of the vehicle to prevent the catalyst from being placed in a high temperature and oxygen-rich state so as to suppress catalyst deterioration when the temperature of the catalyst provided in the exhaust system of the internal combustion engine is high (for example, see Japanese Unexamined Patent Publication (Kokai) No. 10-252532).

However, when prohibiting execution of a fuel cut in this way, while catalyst deterioration is suppressed, there is the problem that a strange odor, more particularly the odor of hydrogen sulfide ($H_2S$), is generated when the vehicle stops after deceleration.

SUMMARY OF THE INVENTION

An object of the present invention is to provide a control device for an internal combustion engine provided with fuel cut executing means for executing a fuel cut for stopping the supply of fuel to the internal combustion engine mounted in a vehicle when the vehicle is in a decelerating state and fuel cut prohibiting means for prohibiting a fuel cut executed by the fuel cut executing means when a temperature of a catalyst provided in an exhaust system of the internal combustion engine is a predetermined temperature or more, wherein the generation of an odor after deceleration is suppressed.

The present invention provides a control device of an internal combustion engine described in the claims as means for achieving the above object.

According to a first aspect of the invention, there is provided a control device of an internal combustion engine provided with fuel cut executing means for executing a fuel cut for stopping the supply of fuel to an internal combustion engine mounted in a vehicle when the vehicle is in a decelerating state and fuel cut prohibiting means for prohibiting a fuel cut executed by the fuel cut executing means when a temperature of a catalyst provided in an exhaust system of the internal combustion engine is a predetermined temperature or more, wherein when a fuel cut is prohibited by the fuel cut prohibiting means when the vehicle decelerates in a predetermined period after an increased fuel operation is performed for operating the internal combustion engine so that a combustion air-fuel ratio becomes rich, the internal combustion engine is operated so that the combustion air-fuel ratio becomes lean in the decelerating state or in the decelerating state and its succeeding idling state.

By prohibiting a fuel cut by such a fuel cut prohibiting means, it is possible to prevent the catalyst from being placed in a high temperature and oxygen-rich state and thereby suppress catalyst deterioration, but in the past, sometimes an odor was produced when stopping the vehicle after deceleration during which such a fuel cut was prohibited. This odor is the odor of hydrogen sulfide produced from the catalyst. The cause is that as a result of the operation performed to prohibit a fuel cut to make the combustion air-fuel ratio (that is, the air-fuel ratio in the combustion chamber) the stoichiometric air-fuel ratio, the air-fuel ratio of the exhaust gas passing through the catalyst during deceleration does not become lean and therefore the sulfur oxides which had been held in the catalyst become hydrogen sulfide which is easily released to the outside. Further, in particular, when the decelerating state is entered right after the above increased fuel operation is performed, the catalyst does not hold sufficient oxygen (that is, the catalyst is in the "reduced state"), so release of such hydrogen sulfide to the outside occurs more easily.

As opposed to this, in the first aspect of the invention, when a fuel cut is prohibited by the fuel cut prohibiting means when the vehicle decelerates in a predetermined period after the increased fuel operation is performed, the internal combustion engine is operated so that the combustion air-fuel ratio becomes lean in the decelerating state or in the decelerating state and its succeeding idling state. By doing this, the amount of oxygen supplied to the catalyst being increased, so the catalyst entering a reduced state after deceleration and the hydrogen sulfide easily being released to the outside is suppressed. Further, as a result, it is possible to suppress the generation of odor after deceleration. That is, according to the first aspect of the invention, it is possible to simultaneously achieve both suppression of catalyst deterioration and suppression of odor generation.

Note that the above predetermined period can for example be defined by the time elapsed after the end of the increased fuel operation. Alternatively, it may be defined based on the cumulative value of the amount of intake air from the end of the increased fuel operation. That is, the cumulative value of the amount of intake air forming the criteria of judgment is set in advance and the above predetermined time is deemed to have elapsed when the cumulative value of the amount of intake air after the end of the increased fuel operation reaches the cumulative value of the criteria of judgment.

Further, when an air-fuel ratio sensor is provided downstream of the catalyst, it is also possible to define the predetermined period based on the output of that air-fuel ratio sensor. That is, in this case, the predetermined period is deemed to have elapsed at the point of time when the output of the air-fuel ratio sensor indicates that the air-fuel ratio of the exhaust gas is lean. Alternatively, when an air-fuel ratio sensor is provided upstream of the catalyst, it is also possible to define the predetermined period by the time elapsed from the point of time when the output of the air-fuel ratio sensor indicates that the air-fuel ratio of the exhaust gas is lean or to define it based on the cumulative value of the amount of intake air from the point of time when the output of the air-fuel ratio sensor indicates that the air-fuel ratio of the exhaust gas is lean.

In the second aspect of the invention, there is provided the first aspect of the invention wherein catalysts are provided separately at two locations in series in the exhaust system of the internal combustion engine and the predetermined period is deemed to have elapsed when it is judged that even the catalyst provided at the downstream side is in an oxidized state where the catalyst holds sufficient oxygen.

When the air-fuel ratio of the exhaust gas passing through a catalyst is lean, the purification rate of the catalyst with respect to the nitrogen oxides (NOx) falls. This tendency becomes particularly marked when a catalyst is in the completely oxidized state. On the other hand, when the catalyst completely enters the oxidized state, the generation of odor due to the hydrogen sulfide after deceleration is suppressed.

When catalysts are separately provided in series at two locations in the exhaust system of the internal combustion engine, when it is judged that the catalyst provided at the downstream side is in the oxidized state, it is believed that both catalysts are in the completely oxidized state. Therefore, in such a case, if the air-fuel ratio of the exhaust gas passing through a catalyst is lean, the nitrogen oxides (NOx) in the exhaust gas will not be able to be sufficiently purified, but the generation of odor due to the hydrogen sulfide after deceleration will be suppressed. That is, in such a case, it is desirable that the engine not be operated to make the combustion air-fuel ratio lean in the above decelerating state or the decelerating state and its succeeding idling state.

In this regard, according to the second aspect of the invention, when it is judged that the catalyst provided at the downstream side is in the oxidized state, it is deemed that the predetermined period has already elapsed and the engine is not operated to make the combustion air-fuel ratio lean in the decelerating state or the decelerating state and its succeeding idling state. Due to this, it is possible to keep the purification of the nitrogen oxides (NOx) from becoming insufficient and suppress the generation of odor due to the hydrogen sulfide after deceleration.

In the third aspect of the invention, there is provided the first aspect of the invention wherein an amount of intake air is increased when the engine is operated so that the combustion air-fuel ratio becomes lean more than when it is operated so that the combustion air-fuel ratio becomes the stoichiometric air-fuel ratio.

By doing this, it is possible to increase the amount of oxygen supplied to a catalyst and more quickly change the state of the catalyst from the reduced state to the oxidized state, so it is possible to more reliably suppress the generation of odor after deceleration. Further, it is possible to reduce the possibility of misfires in the case of operating the engine so that the combustion air-fuel ratio becomes lean.

In the fourth aspect of the invention, there is provided the first aspect of the invention wherein the greater the maximum amount of oxygen held in the catalyst, the longer the time the engine is operated so that the combustion air-fuel ratio becomes lean is made, or the greater the degree of leanness of the combustion air-fuel ratio or the greater the amount of intake air when the engine is operated so that the combustion air-fuel ratio becomes lean.

By doing this, it is possible to more reliably change a catalyst state to the oxidized state and more reliably suppress the generation of odor.

In the fifth aspect of the invention, there is provided the first aspect of the invention wherein the greater the degree of deceleration in the decelerating state, the greater the degree of leanness of the combustion air-fuel ratio or the greater the amount of intake air when the engine is operated so that the combustion air-fuel ratio becomes lean.

By doing this, the greater the degree of deceleration in the decelerating state, the faster the catalyst state can be changed to the oxidized state and the more reliably the generation of odor can be suppressed.

In the sixth aspect of the invention, there is provided the third aspect of the invention wherein the engine is operated so that the combustion air-fuel ratio becomes lean only when the speed of the vehicle is less than a predetermined vehicle speed.

If operating the engine so that the combustion air-fuel ratio becomes lean, oxygen is supplied to the catalyst, so catalyst deterioration is liable to occur. Therefore, the operation of the engine so that the combustion air-fuel ratio becomes lean is preferably performed to the minimum necessary extent from the viewpoint of suppression of the generation of odor.

Further, from the viewpoint of suppression of generation of odor, the operation of the engine so that the combustion air-fuel ratio becomes lean should be performed so that the catalyst state becomes the oxidized state before the vehicle is stopped. Therefore, when the vehicle speed is relatively high, there is no need for this operation even when in the decelerating state. It is sufficient to execute this operation so as to enable the catalyst state to be changed to the oxidized state before the vehicle is stopped when the vehicle speed falls to a certain extent. Further, when the vehicle speed is relatively high, by not operating the engine so that the combustion air-fuel ratio becomes lean, it is possible to keep the engine from being operated so that the combustion air-fuel ratio becomes lean when the accelerator is temporarily released at the time of high speed operation etc., the catalyst from being wastefully supplied with oxygen, and the catalyst from deteriorating.

By doing this, according to the sixth aspect of the invention, it is possible to suppress catalyst deterioration even more and suppress the generation of odor by suitably setting the predetermined vehicle speed.

In the seventh aspect of the invention, there is provided the third aspect of the invention wherein an ignition timing is retarded when an amount of intake air is increased when the engine is operated so that the combustion air-fuel ratio becomes lean more than when it is operated so that the combustion air-fuel ratio becomes the stoichiometric air-fuel ratio.

If the amount of intake air is increased, an increase in the generated torque, a rise in the engine speed, etc. will occur and a deterioration of the deceleration property or a rise in the idling speed etc. may be caused. As opposed to this, in the seventh aspect of the invention, when the amount of intake air is increased, the ignition timing is retarded and the combustion becomes poorer, so it is possible to suppress the above deterioration of the deceleration property or rise in the idling speed. Note that the greater the increase of the amount of intake air, the greater the amount of retardation of the ignition timing can be made.

In the eighth aspect of the invention, there is provided the first aspect of the invention wherein the fuel cut prohibiting means does not prohibit a fuel cut when a degree of deceleration in a decelerating state of the vehicle is larger than a predetermined degree of deceleration.

When the degree of deceleration of the vehicle is large, the time until the vehicle stops is short, so to reliably suppress odor, it is necessary to change a state of catalyst to the oxidized state more quickly. In the eighth aspect of the invention, when the degree of deceleration in the decelerating state of a vehicle is larger than a predetermined degree of deceleration, a fuel cut is performed. When a fuel cut is performed, air flows to the exhaust system as it is, so it is possible to quickly supply more oxygen to a catalyst. Therefore, according to the eighth aspect of the invention, by suitably setting the above predetermined degree of deceleration, it becomes possible to more reliably suppress the above odor.

In the ninth aspect of the invention, there is provided the first aspect of the invention wherein operation of the engine is switched to operation so that the combustion air-fuel ratio becomes the stoichiometric air-fuel ratio when fluctuation of an engine speed becomes larger than a predetermined fluctuation of speed when the engine is operated so that the combustion air-fuel ratio becomes lean.

According to the ninth aspect of the invention, it is possible to prevent misfires and engine stalling accompanying operation of the engine so that the combustion air-fuel ratio becomes lean.

BRIEF DESCRIPTION OF THE DRAWINGS

These and other objects and features of the present invention will become clearer from the following description of the preferred embodiments given with reference to the attached drawings, wherein.

DESCRIPTION OF THE PREFERRED EMBODIMENTS

Figure 1:
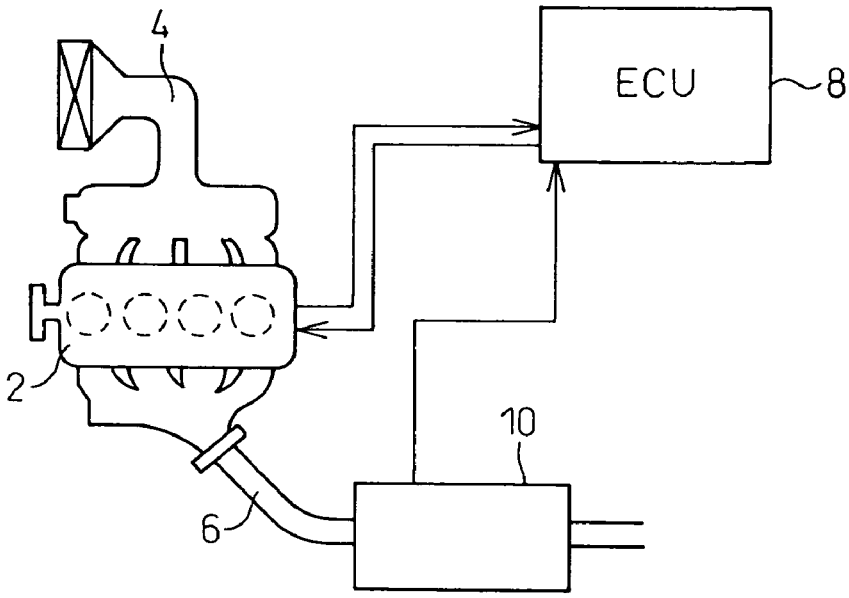
FIG. 1 is a diagram for explaining the case of application of the present invention to a gasoline engine mounted in a vehicle.

Preferred embodiments of the present invention will be described in detail below while referring to the attached figures. FIG. 1 is a view for explaining the case of application of the present invention to a gasoline engine mounted in a vehicle. In FIG. 1, 2 indicates an internal combustion engine body), 4 indicates an intake passage, and 6 indicates an exhaust gas passage. The exhaust gas passage 6 is provided with an exhaust gas purification system 10. As the exhaust gas purification system 10 provided at this part, the various ones explained later with reference to FIG. 2*a* to FIG. 2*c* and FIG. 3*a* to FIG. 3*d* may be used.

An electronic control unit (ECU) 8 is comprised of a known type of digital computer comprised of a central processing unit (CPU), a random access memory (RAM), a read only memory (ROM), and an input/output (I/O) port all connected to each other by a bidirectional bus. This transfers signals with the various sensors and drive devices to calculate the engine speed, amount of intake air, and other parameters necessary for control and performs various control relating to operation of the engine such as control of the combustion air-fuel ratio (control of the fuel injection amount) or control of the ignition timing based on the calculated parameters.

Figure 2A:
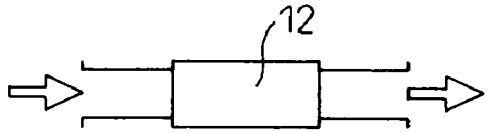
FIG. 2*a* is an explanatory diagram schematically showing an example of the configuration of an exhaust gas purification system arranged at part of an exhaust gas purification system of FIG. 1 and forming part of an exhaust gas passage.
Figure 2B:
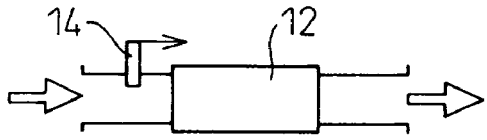
FIG. 2*b* is an explanatory diagram schematically showing another example of the configuration of an exhaust gas purification system.
Figure 2C:
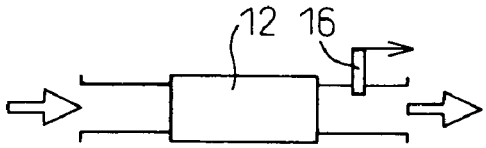
FIG. 2*c* is an explanatory diagram schematically showing still another example of the configuration of an exhaust gas purification system.

FIG. 2*a* to FIG. 2*c* and FIG. 3*a* to FIG. 3*d* are explanatory diagrams schematically showing examples of the configuration of the exhaust gas purification system 10 arranged at the portion of the exhaust gas purification system 10 shown in FIG. 1 and forming part of the exhaust gas passage 6. Here, the exhaust gas flows from the left side of the figure to the right side as shown by the arrows. FIG. 2*a* to FIG. 2*c* show provision of a single three-way catalyst 12. FIG. 2*a*, FIG. 2*b*, and FIG. 2*c* show no provision of an air-fuel ratio sensor for detecting the air-fuel ration of the exhaust gas (or oxygen concentration sensor for detecting the oxygen concentration in the exhaust gas), provision of an upstream air-fuel ratio sensor 14 upstream of the three-way catalyst 12, and provision of a downstream air-fuel ratio sensor 16 downstream of the three-way catalyst 12, respectively.

On the other hand, FIG. 3*a* to FIG. 3*d* show provision of two three-way catalyst 18 and 20, more specifically the provision of the three-way catalyst 18 and 20 seperately in series at two locations in the exhaust system. FIG. 3*a*, FIG. 3*b*, FIG. 3*c*, and FIG. 3*d* show no provision of an air-fuel ratio sensor, provision of an upstream air-fuel ratio sensor 14 upstream of the upstream three-way catalyst 18, provision of a middle air-fuel ratio sensor 15 between the upstream three-way catalyst 18 and downstream three-way catalyst 20, and provision of a downstream air-fuel ratio sensor 16 downstream of the downstream three-way catalyst 20, respectively.

Further, as explained later, in embodiments of the present invention, the method of judging whether a three-way catalyst (hereinafter simply referred to as the "catalyst") 12, 18, or 20 is in the oxidized state where the oxygen is not sufficiently held (that is, the method of judgement of the catalyst state) differs dependent on the configuration of the exhaust gas purification system 10 used.

Note that the exhaust gas purification systems shown in FIG. 2*a* to FIG. 2*c* and FIG. 3*a* to FIG. 3*d* configured with air-fuel ratio sensors are configured so that the outputs of the air-fuel ratio sensors 14, 15, and 16 are transmitted to the electronic control unit 8.

In the embodiments, however, when it is judged that the vehicle in which the internal combustion engine is mounted is in the decelerating state (for example, engine braking state), the supply of the fuel to the internal combustion engine is stopped in a "fuel cut". More specifically, in the embodiments, when the vehicle is in the decelerating state, the accelerator opening degree is zero, and the engine speed is at least a predetermined speed, in principle a fuel cut is performed.

Further, in the embodiments, even when the conditions for such a fuel cut (decelerating state, zero accelerator opening degree, and engine speed over predetermined speed) stand, if the temperature of a catalyst 12, 18, or 20 is a predetermined temperature or more, execution of a fuel cut is prohibited. This is to prevent a fuel cut from being executed when the temperature of the catalyst 12, 18, or 20 is high, and thereby to prevent the catalyst 12, 18, or 20 from being placed in a high temperature and oxygen-rich state and to suppress deterioration of the catalyst.

However, in the past, when prohibiting execution of a fuel cut in this way, there was the problem of an odor when the vehicle stopped after deceleration, more specifically, the odor of hydrogen sulfide ($H_2S$). This problem is believed to occur due to the following reasons. That is, a catalyst provided in the exhaust system of an internal combustion engine (for example, a three-way catalyst) generally has the action of holding the sulfur oxides (SOx) produced when the sulfur components in the fuel burn when the air-fuel ratio of the exhaust gas passing through it is lean. Further, when a catalyst holds sufficient oxygen (that is, when the catalyst is in the "oxidized state"), the catalyst can hold the sulfur oxides in the exhaust gas even when the air-fuel ratio of the exhaust gas passing through it is the stoichiometric air-fuel ratio. Further, due to this action, at normal times where the internal combustion engine is operated with the combustion air-fuel ratio (that is, the air-fuel ratio in the combustion chamber) as the stoichiometric air-fuel ratio, the sulfur oxides in the exhaust gas are held up to the holding ability of the catalyst provided in the exhaust system.

On the other hand, when a catalyst does not hold sufficient oxygen (that is, when the catalyst is in the "reduced state"), if the air-fuel ratio of the exhaust gas passing through the catalyst becomes rich or the stoichiometric air-fuel ratio, the catalyst releases the sulfur oxides which had been held up to then. The sulfur oxides released into the exhaust gas in this way react with the hydrogen produced in the fuel combustion process and catalytic reaction process to become hydrogen sulfide, so an odor (i.e. the odor of hydrogen sulfide) is generated when this is released to the outside.

Further, the odor due to the hydrogen sulfide seldom becomes a problem during moving of the vehicle since the exhaust gas is easily dispersed, but when the vehicle is at a stop, dispersion of the exhaust gas becomes difficult, so the odor remains in the surroundings and easily causes discomfort to the passengers of the vehicle.

If considering the case of prohibition of execution of a fuel cut at the time of deceleration in this way, in the prior art, when a fuel cut is prohibited, the engine is operated with the combustion air-fuel ratio made the stoichiometric air-fuel ratio, so the air-fuel ratio of the exhaust gas passing through the catalyst does not become lean during deceleration and as a result hydrogen sulfide easily is released to the outside. In particular, when the state of an increased fuel and a rich combustion air-fuel ratio is continued for the purpose of increasing the output or lowering the catalyst temperature before deceleration, the catalyst do not hold sufficient oxygen, so the possibility of release of hydrogen sulfide to the outside become higher. Further, when as a result of the deceleration the vehicle speed drops considerably or the vehicle is stopped, the dispersion of exhaust gas become harder as explained above, so the possibility of a problem of odor being generated become much higher.

Therefore, in the embodiments, to deal with the problem of odor explained above, the operation of the engine is specially controlled (more specifically, the combustion air-fuel ratio is controlled) in the decelerating state or the decelerating state and its succeeding idling state to suppress the generation of such an odor. This operational control, simply speaking, means to operate the engine so that the combustion air-fuel ratio becomes lean in the decelerating state or the decelerating state and its succeeding idling state when a fuel cut is prohibited when the engine enters a decelerating state within a predetermined period after execution of an increased fuel operation where the internal combustion engine is operated with the combustion air-fuel ratio made rich.

Figure 4:
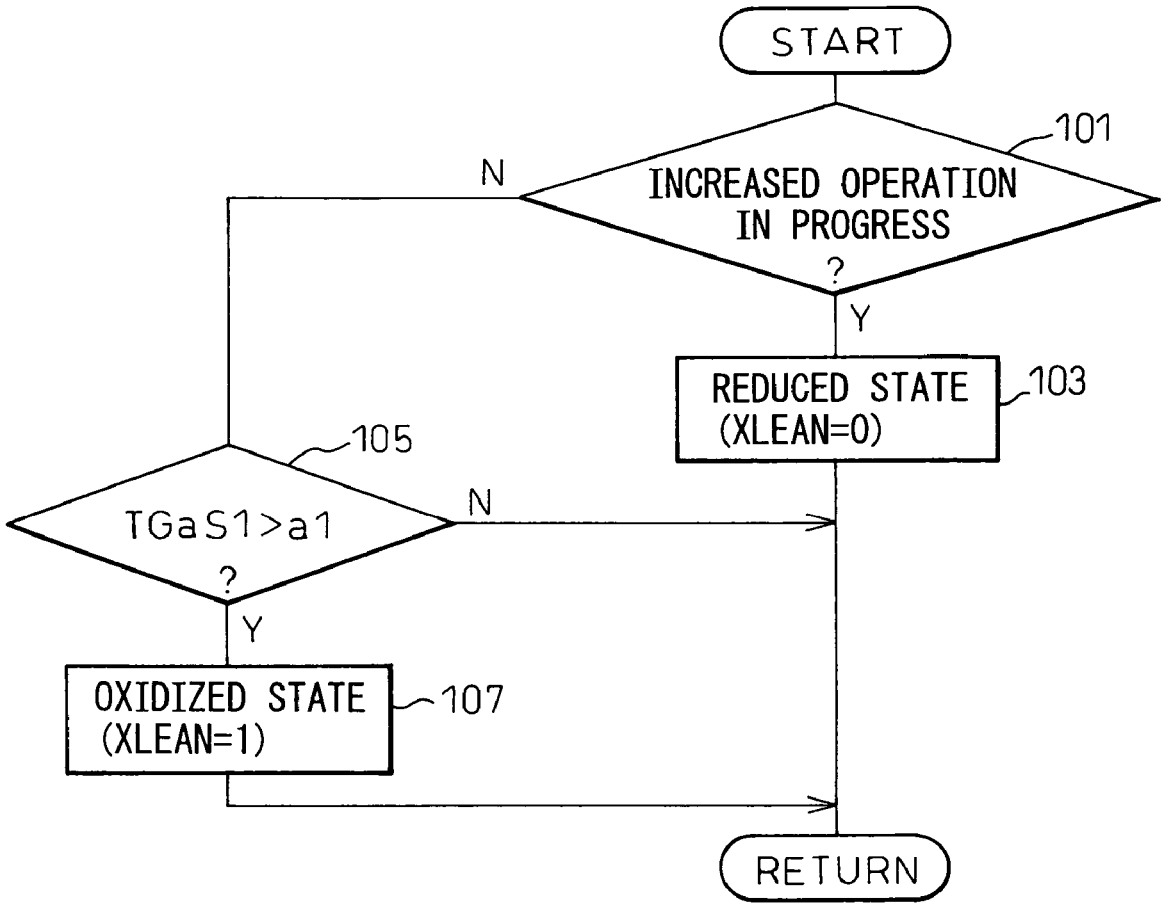
FIG. 4 is a flow chart of a control routine for working a method of judging the state of a catalyst.
Figure 5:
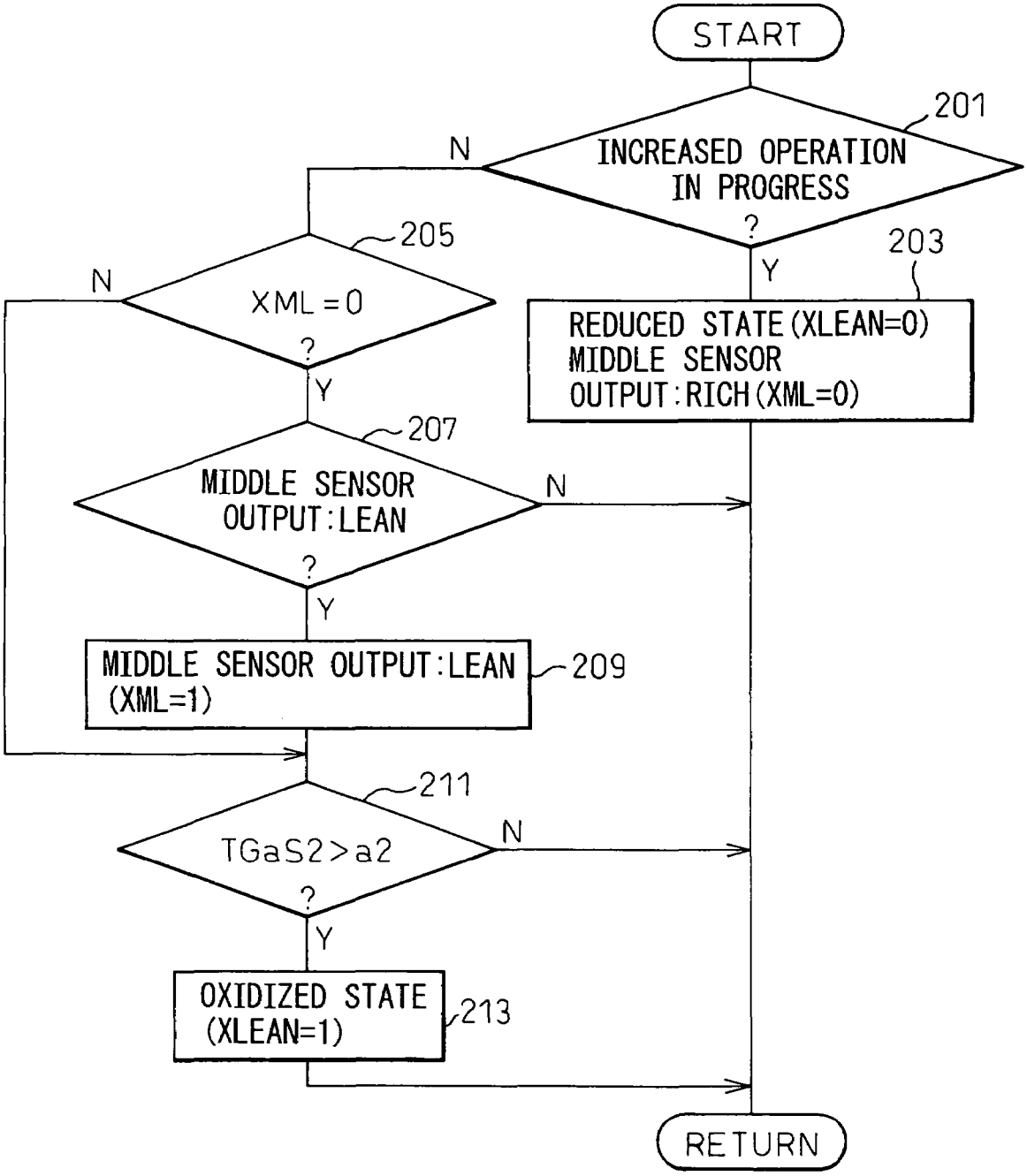
FIG. 5 is a flow chart of a control routine for working another method of judging the state of a catalyst.
Figure 6:
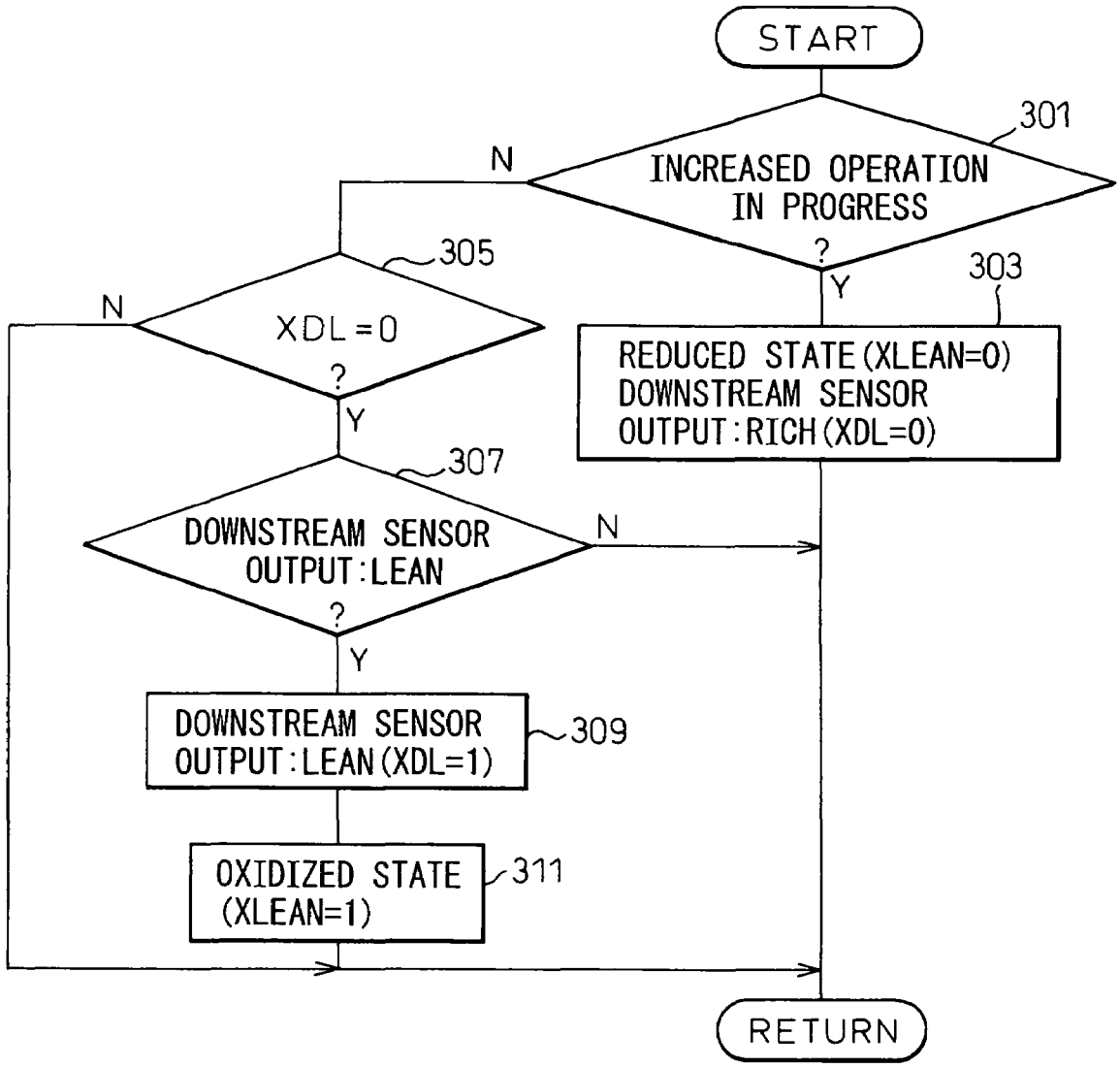
FIG. 6 is a flow chart of a control routine for working still another method of judging the state of a catalyst.

Before specifically explaining the above operational control executed in the present embodiment, here first the method of judgment of the catalyst state (oxidized state or reduced state) required for determining the predetermined period in that operational control will be explained. As explained above, this method of judgment differs depending on the configuration of the exhaust gas purification system 10 used. FIG. 4 to FIG. 6 are flow charts of control routines for execution of the methods of judgment differing according to the configurations of the exhaust gas purification systems 10 used. These control routines are executed repeatedly during operation of the internal combustion engine and are designed to judge the current catalyst state.

First, the method of judgment shown by the flow chart of FIG. 4 is applied to the case where the exhaust gas purification system 10 has a configuration as shown by FIG. 2*a* and FIG. 2*b* and FIG. 3*a* and FIG. 3*b*. That is, it is applied to the case where an air-fuel ratio sensor is not provided or an upstream air-fuel ratio sensor 14 is provided.

When the control routine shown in FIG. 4 starts, first, at step 101, it is judged if an increased fuel operation where the internal combustion engine is operated with the combustion air-fuel ratio made rich is being executed. Note that this increased fuel operation is performed for the purpose of increasing the output or reducing the catalyst temperature.

The judgment as to whether the above increased fuel operation is being executed is performed based on the current target combustion air-fuel ratio used for operational control of the internal combustion engine when an air-fuel ratio sensor is not provided. Further, it is performed based on the air-fuel ratio showing the output when an upstream air-fuel ratio sensor 14 is provided. That is, in both cases, when the air-fuel ratio used for the judgment is rich, it is judged that an increased fuel operation is in progress, while when the air-fuel ratio used for the judgment is not rich, it is judged that an increased fuel operation is not in progress.

When it is judged at step 101 that an increased fuel operation is being executed, the routine proceeds to step 103, where it is judged that the catalyst state is the reduced state and the catalyst state flag XLEAN is made 0 (judgment of reduced state). On the other hand, when it is judged at step 101 that an increased fuel operation is not in progress, the routine proceeds to step 105, where it is judged if the cumulative value TGaS1 of the amount of intake air after the increased fuel operation is larger than a predetermined cumulative value al of the amount of intake air.

When it is judged at step 105 that the cumulative value TGaS1 is larger than the cumulative value a1, the routine proceeds to step 107, where it is judged that the catalyst state is the oxidized state and the catalyst state flag XLEAN is made 1 (judgment of oxidized state). On the other hand, when it is judged at step 105 that the cumulative value TGaS1 is not more than the cumulative value a1 , the result of judgment of the catalyst state when the control routine was performed the previous time (that is the value of the catalyst state flag XLEAN) is maintained.

As clear from the above explanation as well, the cumulative value a1 serving as the criteria for judgment at step 105 is the value at which it is judged that all of the catalysts are in the reduced state when the cumulative value TGaS1 is larger than that value and is determined in advance by experiments etc. considering this. Further, as the amount of intake air for finding the cumulative value TGaS1 etc., it is possible to use the amount of intake air estimated from the operating state of the internal combustion engine etc. or to provide an air flowmeter and use its detected value.

Note that here the catalyst state was judged based on the cumulative value TGaS1 of the amount of intake air after the end of the increased fuel operation, but instead of this for example it is also possible to judge the catalyst state based on the time elapsed from the end of the increased fuel operation. That is, for example, when the time elapsed after the end of the increased fuel operation exceeds the elapsed time serving as the predetermined judgment criteria, it is judged that the catalyst state is the oxidized state and the catalyst state flag XLEAN is made 1.

Figure 3A:
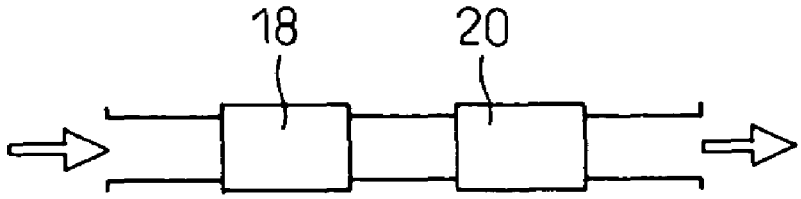
FIG. 3*a* is an explanatory diagram schematically showing an example of the configuration of an exhaust gas purification system provided with two catalysts.
Figure 3B:
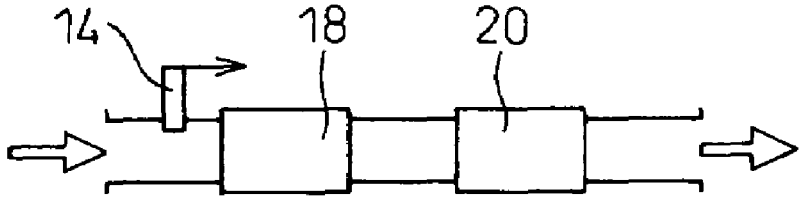
FIG. 3*b* is an explanatory diagram schematically showing another example of the configuration of an exhaust gas purification system provided with two catalysts.
Figure 3C:
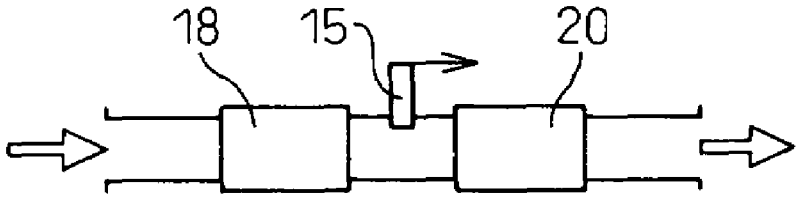
FIG. 3*c* is an explanatory diagram schematically showing still another example of the configuration of an exhaust gas purification system provided with two catalysts.

Next, the method of judgment shown in the flow chart of FIG. 5 will be explained. This method of judgment is applied to the case where the exhaust gas purification system 10 has a configuration such as shown in FIG. 3*c*. That is, it is applied to the case where catalysts 18 and 20 are provided separately at two locations in series in the exhaust system and a middle air-fuel ratio sensor 15 is provided between these catalysts 18 and 20.

When the control routine shown in FIG. 5 is started, first, at step 201, it is judged if an increased fuel operation is being executed. This judgment is made based on the current target combustion air-fuel ratio used for the operational control of the internal combustion engine when only the middle air-fuel ratio sensor 15 is provided. Further, when the upstream air-fuel ratio sensor such as shown in FIG. 3*b* is provided in addition to the middle air-fuel ratio sensor 15, the judgment may be rendered based on the air-fuel ratio shown by the output of the upstream air-fuel ratio sensor. In either case, when the air-fuel ratio used for the judgment is rich, it is judged that an increased fuel operation is in progress, while when the air-fuel ratio used for the judgment is not rich, it is judged that an increased fuel operation is not in progress.

When it is judged at step 201 that an increased fuel operation is in progress, the routine proceeds to step 203 where it is judged that the catalyst state is the reduced state and the catalyst state flag XLEAN is made 0 (judgment of reduced state). Further, in this case, the output of the middle air-fuel ratio sensor 15 is considered to indicate rich, and the middle sensor judgment flag XML is made 0 (rich judgment). On the other hand, when it is judged at step 201 that the increased fuel operation is not in progress, the routine proceeds to step 205, where it is judged if the middle sensor judgment flag XML is 0 or not. This step is for confirming the results of judgment when the control routine was performed the previous time.

The case when it is judged at step 205 that the middle sensor judgment flag XML is 0 is the case where the output of the middle air-fuel ratio sensor 15 was made to indicate rich when the control routine was performed the previous time. In this case, the routine proceeds to step 207, where it is judged if the current output of the middle air-fuel ratio sensor 15 indicates lean. On the other hand, the case when it is judged at step 205 that the middle sensor judgment flag XML is not 0 (that is, is 1) is the case where the output of the middle air-fuel ratio sensor 15 indicated lean when the control routine was performed the previous time. In this case, the routine proceeds to step 211.

When it is judged at step 207 that the current output of the middle air-fuel ratio sensor 15 indicates lean, the routine proceeds to step 209 where the middle sensor judgment flag XML is made 1 (lean judgment), then the routine proceeds to step 211. On the other hand, when it is judged at step 207 that the current output of the middle air-fuel ratio sensor 15 does not indicate lean, the results of judgment of the catalyst state and the output of the middle air-fuel ratio sensor at the time the control routine was previous performed (that is, the value of the catalyst state flag XLEAN and the value of the middle sensor judgment flag XML) are maintained as they are and the current control routine is ended.

When the routine proceeds to step 211, it is judged if the cumulative value TGaS2 of the amount of intake air after the output of the middle air-fuel ratio sensor 15 indicates that the air-fuel ratio of the exhaust gas is lean is greater than a predetermined cumulative value a2 of the amount of intake air. Further, when it is judged at step 211 that the cumulative value TGaS2 is greater than the cumulative value a2, the routine proceeds to step 213, where it is judged that the catalyst state is the oxidized state and the catalyst state flag XLEAN is made 1 (judgment of oxidized state). On the other hand, when it is judged at step 211 that the cumulative value TGaS2 is the cumulative value a2 or less, the result of judgment of the catalyst state when the control routine was performed the previous time (that is, the value of the catalyst state flag XLEAN) is maintained.

Note that here when the output of the middle air-fuel ratio sensor 15 indicates that the air-fuel ratio of the exhaust gas is lean, it is believed that the upstream catalyst 18 is in the oxidized state. Therefore, the cumulative value a2 serving as the criteria of judgment can more specifically be said to be a value where it is judged that the downstream catalyst 20 is also in the oxidized state when the cumulative value TGaS2 is larger than this value and is determined in advance by experiments considering this. Further, in the same way as the case of the above cumulative value TGaS1, as the amount of intake air for finding this cumulative value TGaS2, it is possible to use the amount of intake air estimated from the operating state of the internal combustion engine etc. or to provide an air flowmeter and use its detected value.

Further, here, the catalyst state was judged based on the cumulative value TGaS2 of the amount of intake air after the output of the middle air-fuel ratio sensor 15 indicated that the air-fuel ratio of the exhaust gas is lean, but instead of this for example it is also possible to judge the catalyst state based on the time elapsed after the output of the middle air-fuel ratio sensor 15 indicated that the air-fuel ratio of the exhaust gas is lean. That is, for example, when the time elapsed after the output of the middle air-fuel ratio sensor 15 indicated that the air-fuel ratio of the exhaust gas is lean exceeds the elapsed time serving as the predetermined judgment criteria, it is judged that the catalyst state is the oxidized state and the catalyst state flag XLEAN is made 1.

Figure 3D:
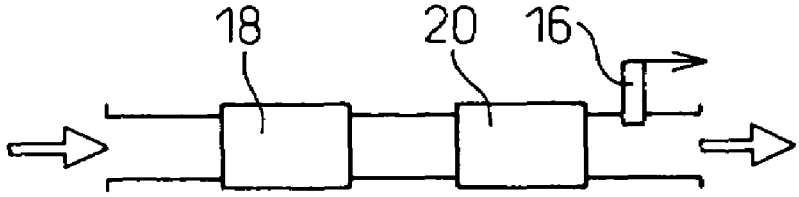
FIG. 3*d* is an explanatory diagram schematically showing still another example of the configuration of an exhaust gas purification system provided with two catalysts.

Next, the method of judgment shown in the flow chart of FIG. 6 will be explained. This method of judgment is applied to the case where the exhaust gas purification system 10 has a configuration such as shown in FIG. 2*c* or FIG. 3*d*. That is, it is applied to the case where a downstream air-fuel ratio sensor 16 is provided.

When the control routine shown in FIG. 6 is started, in the same way as the case of the control routine shown in FIG. 4 and FIG. 5, first, at step 301, it is judged if an increased fuel operation is in progress. This judgment is made based on the current target combustion air-fuel ratio used for the operational control of the internal combustion engine when only the downstream air-fuel ratio sensor 16 is provided. Further, when the upstream air-fuel ratio sensor 14 is also provided such as shown in FIG. 2*b* or FIG. 3*b* in addition to the downstream air-fuel ratio sensor 16, the judgment may be rendered based on the air-fuel ratio shown by the output of the upstream air-fuel ratio sensor 14. In either case, when the air-fuel ratio used for the judgment is rich, it is judged that an increased fuel operation is in progress, while when the air-fuel ratio used for the judgment is not rich, it is judged that an increased fuel operation is not in progress.

When it is judged at step 301 that an increased fuel operation is in progress, the routine proceeds to step 303 where it is judged that the catalyst state is the reduced state and the catalyst state flag XLEAN is made 0 (judgment of reduced state). Further, in this case, the output of the downstream air-fuel ratio sensor 16 is made to indicate rich, and the downstream sensor judgment flag XDL is made 0 (rich judgment). On the other hand, when it is judged at step 301 that the increased fuel operation is not in progress, the routine proceeds to step 305, where it is judged if the downstream sensor judgment flag XDL is 0 or not. This step is for confirming the results of judgment when the control routine was performed the previous time.

The case when it is judged at step 305 that the downstream sensor judgment flag XDL is 0 is the case where the output of the downstream air-fuel ratio sensor 16 was made to indicate rich when the control routine was performed the previous time. In this case, the routine proceeds to step 307, where it is judged if the current output of the downstream air-fuel ratio sensor 16 indicates lean. On the other hand, the case when it is judged at step 305 that the downstream sensor judgment flag XDL is not 0 (that is, is 1) is the case where the output of the downstream air-fuel ratio sensor 16 indicated lean when the control routine was performed the previous time. In this case, the results of judgment of the catalyst state and the output of the downstream air-fuel ratio sensor at the time the control routine was previously performed (that is, the value of the catalyst state flag XLEAN and the value of the downstream sensor judgment flag XDL) are maintained as they are and the current control routine is ended. More specifically, in this case, the results of judgment that the catalyst state is the oxidized state (XLEAN=1) and the output of the downstream air-fuel ratio sensor indicates lean (XDL=1) are maintained.

When it is judged at step 307 that the current output of the downstream air-fuel ratio sensor 16 indicates lean, the routine proceeds to step 309, where the downstream sensor judgment flag XDL is made 1 (lean judgment), then at the following step 311, it is judged that the catalyst state is the oxidized state and the catalyst state flag XLEAN is made 1 (judgment of oxidized state). On the other hand, when it is judged at step 307 that the current output of the downstream air-fuel ratio sensor 16 does not indicate lean, in the same way as the case where it is judged at step 305 that the downstream sensor judgment flag XDL is not 0 (that is, is 1), the results of judgment of the catalyst state of the downstream air-fuel ratio sensor when the control routine was previously performed and the output (that is, the value of the catalyst state flag XLEAN and the value of the downstream sensor judgment flag XDL) are maintained as they are and the current control routine is ended. However, in this case, the results of judgment that the catalyst state is the reduced state (XLEAN=0) and the output of the downstream air-fuel ratio sensor indicates rich (XDL=0) are maintained.

In this way, in the method of judgment shown in the flow chart of FIG. 6, the catalyst state is judged using the output of the downstream air-fuel ratio sensor 16. By doing this, it is possible to reliably judge that all of the catalysts, in particular even the catalyst provided at the downstream side when catalysts are provided separately at two locations in series in the exhaust system, have become the oxidized state. Further, conversely, when catalysts are provided separately at two locations in series in the exhaust system, when it is judged that the catalyst state is the oxidized state by this method of judgment, it can be said that it was judged that even the catalyst provided at the downstream side is in the oxidized state.

Figure 7:
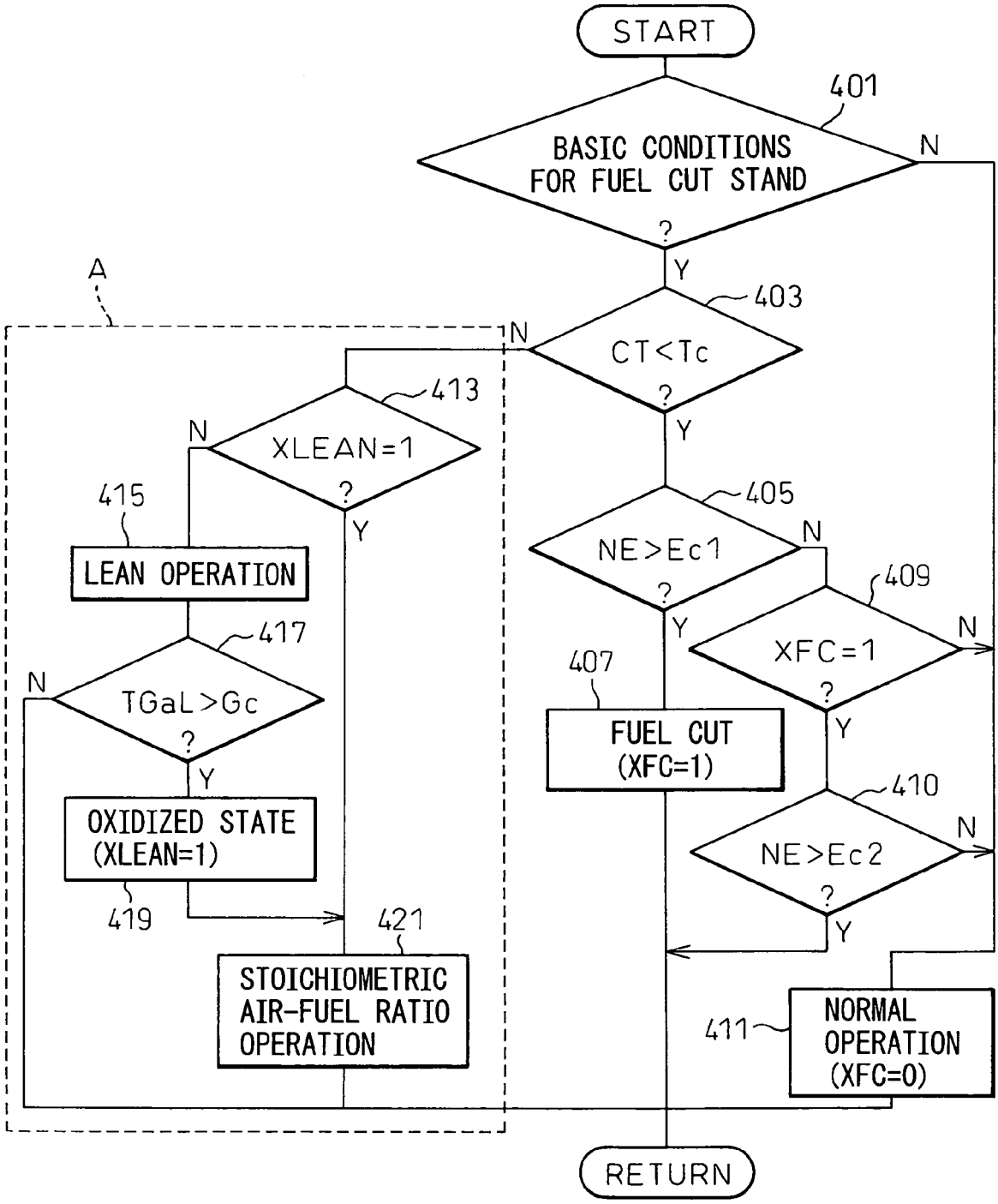
FIG. 7 is a flow chart of a control routine of operational control executed in an embodiment of the present invention.

Next, in the present embodiment, the operational control executed in the decelerating state or the decelerating state and the succeeding idling state will be explained with reference to FIG. 7 so as to deal with the above problem of odor. FIG. 7 is a flow chart showing the control routine for executing this operational control. This control routine is executed by the ECU 8 by interruption every certain time period.

When this control routine starts, first, at step 401, it is judged if the basic conditions for a fuel cut stand. The basic conditions for a fuel cut in this embodiment are that the vehicle be in the decelerating state and that the accelerator opening degree be zero. When it is judged at step 401 that the basic conditions for a fuel cut do not stand, the routine proceeds to step 411, a normal operation where the combustion air-fuel ratio is determined in accordance with the engine speed and the accelerator opening degree is executed, the fuel cut execution flag XFC is made 0, and the control routine is ended.

On the other hand, when it is judged at step 401 that the basic conditions for a fuel cut stand, the routine proceeds to step 403, where it is judged if the temperature CT of the catalyst when the vehicle starts decelerating is less than a predetermined temperature Tc. As clear from the later explanation, this judgment is performed for preventing a fuel cut from being executed when the temperature of the catalyst is high so that the catalyst is not placed in a high temperature and oxygen-rich state. The temperature Tc is determined in advance by experiments etc. based on this concept and is for example 800° C. Further, a catalyst temperature CT may be determined by providing a temperature sensor at the catalyst 12, 18, or 20 and determining it based on the output. It is also possible to detect the exhaust gas temperature and determine it based on this temperature. Alternatively, it is also possible to estimate it from the operating state of the internal combustion engine before deceleration or the history of operation.

When it is judged at step 403 that the catalyst temperature CT is less than the predetermined temperature TC, the routine proceeds to step 405, where it is judged if the engine speed NE is larger than the predetermined first engine speed Ec1. This judgment is performed to prevent a fuel cut from being started when the engine speed NE is low and thereby to prevent the engine from stalling. The predetermined first engine speed Ec1 is determined in advance by experiments based on this concept.

When it is judged at step 405 that the engine speed NE is larger than the predetermined first engine speed Ec1, the routine proceeds to step 407, where a fuel cut is executed and the fuel cut execution flag XFC is made 1, then the control routine is ended. On the other hand, when it is judged at step 405 that the engine speed NE is the predetermined first engine speed Ec1 or less, the routine proceeds to step 409, where it is judged if the fuel cut execution flag XFC is 1. This judgment is judgment as to if a fuel cut is in progress.

When it is judged at step 409 that the fuel cut execution flag XFC is not 1, that is, a fuel cut is not in progress, the routine proceeds to step 411, where normal operation is performed. That is, this case is the case where the engine is liable to stall if a fuel cut is started since the engine speed NE is low. The engine is operated normally without a fuel cut. On the other hand, when it is judged at step 409 that the fuel cut execution flag XFC is 1, that is, a fuel cut is in progress, the routine proceeds to step 410, where it is judged if the engine speed NE is larger than a predetermined second engine speed Ec2. Here, the second engine speed Ec2 is a value smaller than the first engine speed Ec1.

Further, when it is judged at step 410 that the engine speed NE is larger than the predetermined second engine speed Ec2, the control routine is ended as is, that is, in the state with the fuel cut being executed. On the other hand, when it is judged at step 410 that the engine speed NE is the predetermined second engine speed Ec2 or less, the routine proceeds to step 411, where the engine is operated normally while suspending any fuel cut. In this case, the engine starts to be operated normally while suspending a fuel cut, the fuel cut execution flag XFC is made 0, and the control routine is ended.

In this way, in this embodiment, apart from the engine speed Ec1 for judging whether to start a fuel cut, a separate engine speed Ec2 (<Ec1) for judging whether to suspend a fuel cut is set. Further, by providing hysterisis for the condition of the engine speed relating to the execution of a fuel cut, it is possible to suppress repeated start and suspension of fuel cuts.

On the other hand, the case when it is judged at step 403 that the catalyst temperature CT is the predetermined temperature Tc or more is the case where a fuel cut is prohibited to suppress catalyst deterioration. In this case, the routine proceeds to step 413, where it is judged if the catalyst state flag XLEAN is 1. This judgment is judgment as to if the catalyst state is the oxidized state. When it is judged at step 413 that the catalyst state flag XLEAN is 1, that is, the catalyst state is the oxidized state, the routine proceeds to step 421, where the engine is operated so that the combustion air-fuel ratio becomes the stoichiometric air-fuel ratio (stoichiometric air-fuel ratio operation) and the control routine is ended. That is, in this case, the control routine is ended in the state of operating the engine so that the air-fuel ratio becomes the stoichiometric air-fuel ratio in the decelerating state or the decelerating state and its subsequent idling state (more specifically, the control routine is executed again from the start). Note that in this case, as explained above, even if a stoichiometric air-fuel ratio operation is performed, the generation of odor is suppressed since the catalyst is in the oxidized state.

On the other hand, when it is judged at step 413 that the catalyst state flag XLEAN is not 1, that is, the catalyst state flag XLEAN is 0 and the catalyst state is the reduced state, the routine proceeds to step 415 where the engine is operated so that the combustion air-fuel ratio is lean (lean operation), then the routine proceeds to step 417. That is, in this case, the routine proceeds to step 417 in the state of the engine operating so that the air-fuel ratio becomes lean in the decelerating state or the decelerating state and its following idling state.

At step 417, it is judged if the cumulative value TGaL of the amount of intake air after the start of the lean operation is greater than the predetermined cumulative amount Gc of the amount of intake air. Further, when it is judged at step 417 that the cumulative value TGaL is greater than the cumulative value Gc, the routine proceeds to step 419, where it is judged that the catalyst state is the oxidized state and the catalyst state flag XLEAN is made 1 (judgment of oxidized state). Further, in this case, the routine proceeds to step 421, where the engine starts to be operated so that the combustion air-fuel ratio becomes the stoichiometric air-fuel ratio (stoichiometric air-fuel ratio operation) and the control routine is ended (more specifically, the control routine is executed again from the start). On the other hand, when it is judged at step 417 that the cumulative value TGaL is the cumulative value Gc or less, the control routine is ended as is, that is, in the state of executing the lean operation (more specifically, the control routine is executed again from the start).

Note that as clear from the above explanation, the cumulative value Gc serving as the criteria for judgment at step 417 is the value at which it is judged that the catalyst has become the oxidized state if the cumulative value TGaL is larger than that value, is the value for switching from lean operation to the stoichiometric air-fuel ratio operation, and is determined in advance by experiments etc. considering this concept. Further, as the amount of intake air for finding the cumulative value TGaL, it is possible to use the amount of intake air estimated from the operating state of the internal combustion engine etc. or to provide an air flowmeter and use its detected value.

As explained above, in the present embodiment, when the catalyst temperature is high and a fuel cut is prohibited when the vehicle is in a decelerating state, when the catalyst state flag XLEAN is not 1, that is, the catalyst state flag XLEAN is 0, and it is judged that the catalyst state is the reduced state, the engine is operated so that the combustion air-fuel ratio becomes lean (lean operation). Here, when the vehicle is in the decelerating state, it is judged that the catalyst state is the reduced state (XLEAN=0), as clear from the explanation given with reference to FIG. 4 to FIG. 6, for the period until a predetermined condition is satisfied after an increased fuel operation operating the engine so that the air-fuel ratio becomes rich, that is, a predetermined period. Therefore, in other words, in the present embodiment, when a fuel cut is prohibited when the decelerating state is entered in a predetermined period after the increased fuel operation, the engine can be said to be operated so that the combustion air-fuel ratio becomes lean in that decelerating state or that decelerating state and the following idling state.

Further, if the engine is operated so that the combustion air-fuel ratio becomes lean, the air-fuel ratio of the exhaust gas flowing into the catalyst provided in the exhaust system becomes lean, so the state where the amount of oxygen supplied to the catalyst is increased, the catalyst enters the reduced state after deceleration, and hydrogen sulfide easily is released outside is suppressed. Further, as a result, it is possible to suppress the generation of odor after deceleration. Further, in this case, while the amount of oxygen supplied to the catalyst is increased, an oxygen-rich state of the extent of execution of a fuel cut will not be reached and catalyst deterioration can also be suppressed. That is, according to this embodiment, it is possible to achieve both suppression of the catalyst deterioration and suppression of the generation of odor.

However, when the air-fuel ratio of the exhaust gas passing through the catalysts is lean, the purification rates of the catalysts 12, 18, and 20 with respect to nitrogen oxides (NOx) fall. This tendency is particularly remarkable when the catalysts completely enter the oxidized state. On the other hand, when the catalysts completely enter the oxidized state, the generation of odor due to the hydrogen sulfide after deceleration is suppressed.

For example, when catalysts 18 and 20 are separately provided at two locations in series in the exhaust system of the internal combustion engine as in the configuration shown in FIG. 3, when it is judged that the catalyst 20 provided at the downstream side is in the oxidized state, it is believed that the two catalysts 18 and 20 are both completely in the oxidize state. Therefore, in this case, if the air-fuel ratio of the exhaust gas passing through the catalysts is lean, the nitrogen oxides (NOx) in the exhaust gas cannot be sufficiently purified, but the generation of odor due to the hydrogen sulfide after deceleration is suppressed. That is, in this case, it is preferable that the engine not be operated under a lean combustion air-fuel ratio in such a decelerating state or decelerating state and the following idling state.

On this point, in the present embodiment, as explained with reference to FIG. 4 to FIG. 6, when it is judged that all of the catalysts including the catalyst 20 provided at the downstream side are in the oxidized state, the catalyst state flag XLEAN is made 1 (judgment of oxidized state). Further, when the catalyst state flag XLEAN is 1, the engine is not operated under a lean combustion air-fuel ratio in the above decelerating state or decelerating state and the following idling state. Therefore, according to this embodiment, it is possible to suppress the insufficient purification of the nitrogen oxides (NOx) and suppress the generation of odor due to hydrogen sulfide after deceleration.

Note that in the above explanation, the catalyst state was judged and it was determined whether to switch from the lean operation to the stoichiometric air-fuel ratio operation based on the cumulative value TGaL of the amount of intake air after the start of the lean operation, but instead of this for example it is also possible to judge the catalyst state and determine whether to switch from the lean operation to the stoichiometric air-fuel ratio operation based on the time elapsed from the end of the start of the lean operation (that is, the duration of the lean operation). That is, for example, when the time elapsed after the start of the lean operation exceeds the elapsed time Pc serving as the predetermined judgment criteria, it is judged that the catalyst state is the oxidized state, the catalyst state flag XLEAN is made 1, and the lean operation is switched to the stoichiometric air-fuel ratio operation.

Further, the cumulative value Gc serving as a criteria of judgment at step 417 or the elapsed time Pc serving as the above criteria of judgment may also be changed in accordance with the degree of leanness of the combustion air-fuel ratio at the time of lean operation or the degree of deterioration of the catalysts. That is, for example, the higher the degree of leanness of the combustion air-fuel ratio at the time of lean operation or the higher the degree of deterioration of the catalysts, the smaller the value of the cumulative value Gc, or the elapsed time Pc, is made.

The higher the degree of leanness of the combustion air-fuel ratio at the time of lean operation, the greater the amount of oxygen supplied to the catalysts. Further, the higher the degree of deterioration of the catalysts, the smaller the amount of oxygen held in the catalysts (maximum amount of oxygen held). Therefore, the higher the degree of leanness of the air-fuel ratio at the time of lean operation or the higher the degree of deterioration of the catalysts, the more easily the catalysts can become the oxidized state. Therefore, as explained above, if the higher the degree of leanness of the combustion air-fuel ratio at the time of lean operation or the higher the degree of deterioration of the catalysts, the smaller the value of the cumulative value Gc or the elapsed time Pc is made, it becomes possible to judge the catalyst state more suitably. By doing this, it is possible to suppress catalysts being placed in an oxygen-rich state and deterioration progressing.

Below, other embodiments of the present invention will be explained. Note that the embodiments explained below have many parts common with the above embodiments in configuration and action and effects. The explanation of these common parts will in principle be omitted.

Figure 8:
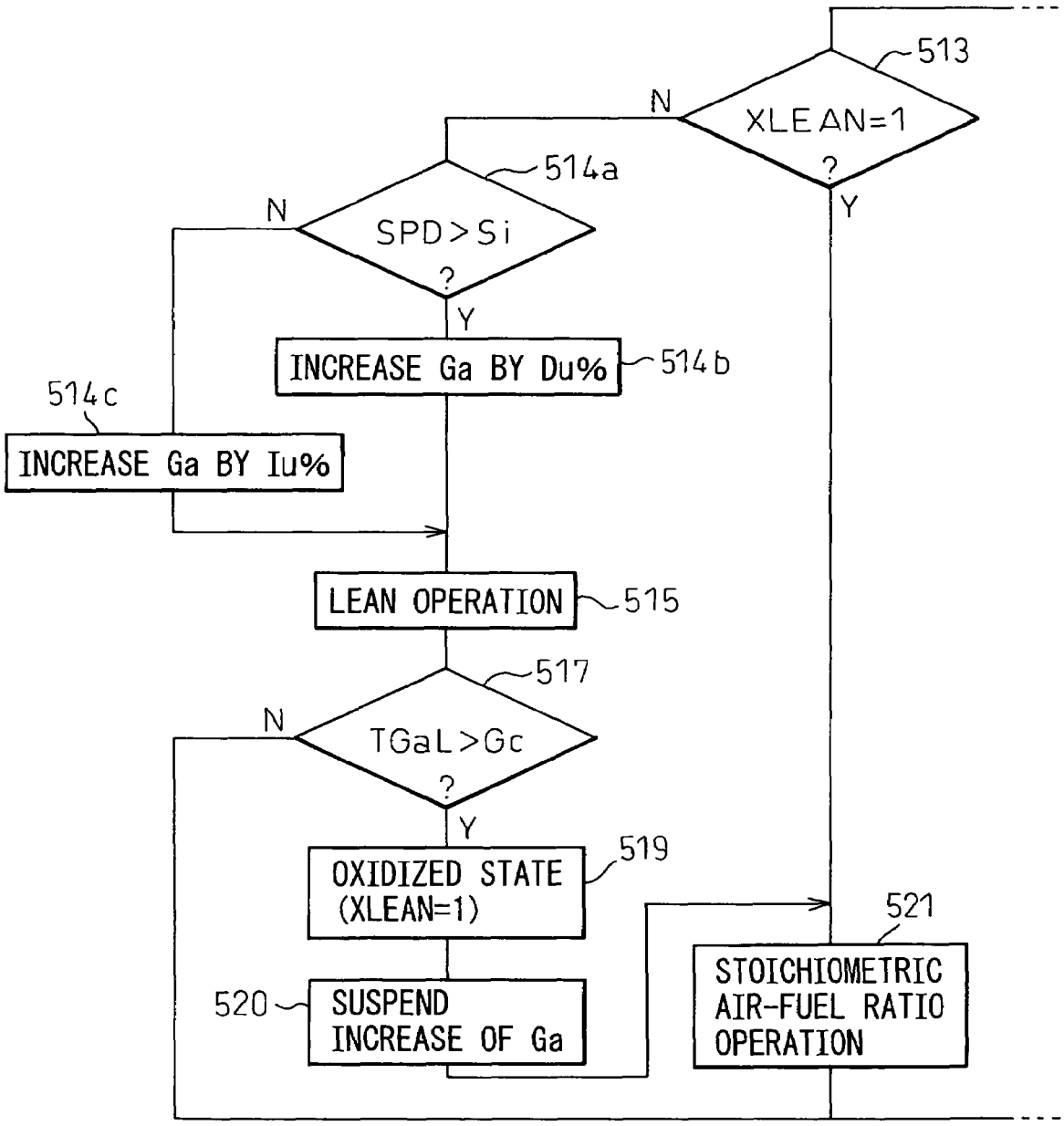
FIG. 8 is a flow chart of a control routine (partial) of operational control executed in another embodiment of the present invention.

In the embodiment explained next referring to FIG. 8, when operating the engine so that the combustion air-fuel ratio becomes lean, the amount of intake air is increased more than when operating the engine so that the combustion air-fuel ratio becomes the stoichiometric air-fuel ratio. FIG. 8 is a flow chart showing an example of (part of) the control routine for executing this operational control. By substituting this part shown in FIG. 8 for the part A surrounded by dotted lines of the control routine shown in FIG. 7, it is possible to obtain the overall control routine for executing the operational control of the present embodiment.

In the control routine shown in FIG. 8, the contents of the control of steps 513, 515, 517, 519, and 521 are substantially the same as the contents of the control of steps 413, 415, 417, 419, and 421 in the control routine shown in FIG. 7, respectively. As shown in FIG. 8, in the present embodiment as well, when it is judged at step 513 that the catalyst state flag XLEAN is 1, that is, the catalyst state is the oxidized state, the routine proceeds to step 521 where the engine is operated so that the combustion air-fuel ratio becomes the stoichiometric air-fuel ratio (stoichiometric air-fuel ratio operation) and the control routine is ended (more specifically the control routine is executed again from the start).

On the other hand, when it is judged at step 513 that the catalyst state flag XLEAN is not 1, that is, the catalyst state flag XLEAN is 0 and the catalyst state is the reduced state, the routine proceeds to step 514*a*, where it is judged if the current speed of the vehicle (vehicle speed) SPD is larger than the predetermined vehicle speed Si or not. Here, the predetermined vehicle speed Si is for judging if the current state of the vehicle is in the decelerating state or in the idling state where the vehicle has substantially stopped and, for example, is made 5 km/h.

Further, when it is judged at step 514*a* that the vehicle speed SPD is larger than the predetermined vehicle speed Si, the vehicle is deemed to be in the decelerating state and the routine proceeds to step 514*b* and step 515, where a lean operation where the amount of intake air Ga is increased by exactly a predetermined ratio Du % (decelerating state) over the case of operating the engine so that the combustion air-fuel ratio becomes the stoichiometric air-fuel ratio is executed. On the other hand, when it is judged at step 514*a* that the vehicle speed SPD is the predetermined vehicle speed Si or less, the vehicle is deemed to be in the idling state and the routine proceeds to step 514*c* and step 515, where a lean operation where the amount of intake air Ga is increased by exactly a predetermined ratio Iu % (idling state) over the case of operating the engine so that the combustion air-fuel ratio becomes the stoichiometric air-fuel ratio is executed. While clear from the above explanation as well, here Du and Iu are the rates of increase of the amount of intake air Ga for the case of the decelerating state and the case of the idling state. Suitable values are found in advance by experiments etc.

At step 517 after step 515, in the same way as the above step 417, it is judged if the cumulative value TGaL of the amount of intake air after the start of the lean operation is greater than the predetermined cumulative amount Gc of the amount of intake air. Further, when it is judged at step 517 that the cumulative value TGaL is greater than the cumulative value Gc, the routine proceeds to step 519, where it is judged that the catalyst state is the oxidized state and the catalyst state flag XLEAN is made 1 (judgment of oxidized state), then at step 520, the control for increasing the amount of intake air Ga is suspended. Further, in this case, the routine proceeds to step 521, where the engine starts to be operated so that the combustion air-fuel ratio becomes the stoichiometric air-fuel ratio (stoichiometric air-fuel ratio operation) and the control routine is ended (more specifically, the control routine is executed again from the start). On the other hand, when it is judged at step 517 that the cumulative value TGaL is the cumulative value Gc or less, the control routine is ended as is, that is, in the state of executing the lean operation (more specifically, the control routine is executed again from the start).

As explained above, in the present embodiment, when the engine is operated so that the combustion air-fuel ratio becomes lean, the amount of intake air is increased over the case of operating the engine so that the combustion air-fuel ratio becomes the stoichiometric air-fuel ratio. Further, by doing this, it is possible to increase the amount of oxygen supplied to the catalysts and therefore change the catalyst state from the reduced state to the oxidized state faster, so it is possible to more reliably suppress the generation of odor after deceleration. Further, it is possible to reduce the possibility of misfires in the case of operating the engine so that the combustion air-fuel ratio becomes lean.

Note that in this embodiment, when the routine proceeds to the step corresponding to step 411 of FIG. 7, where normal operation is started, in the state of executing control for increasing the amount of intake air Ga, only naturally the control for increasing the amount of intake air Ga is suspended when starting the normal operation.

Figure 9:
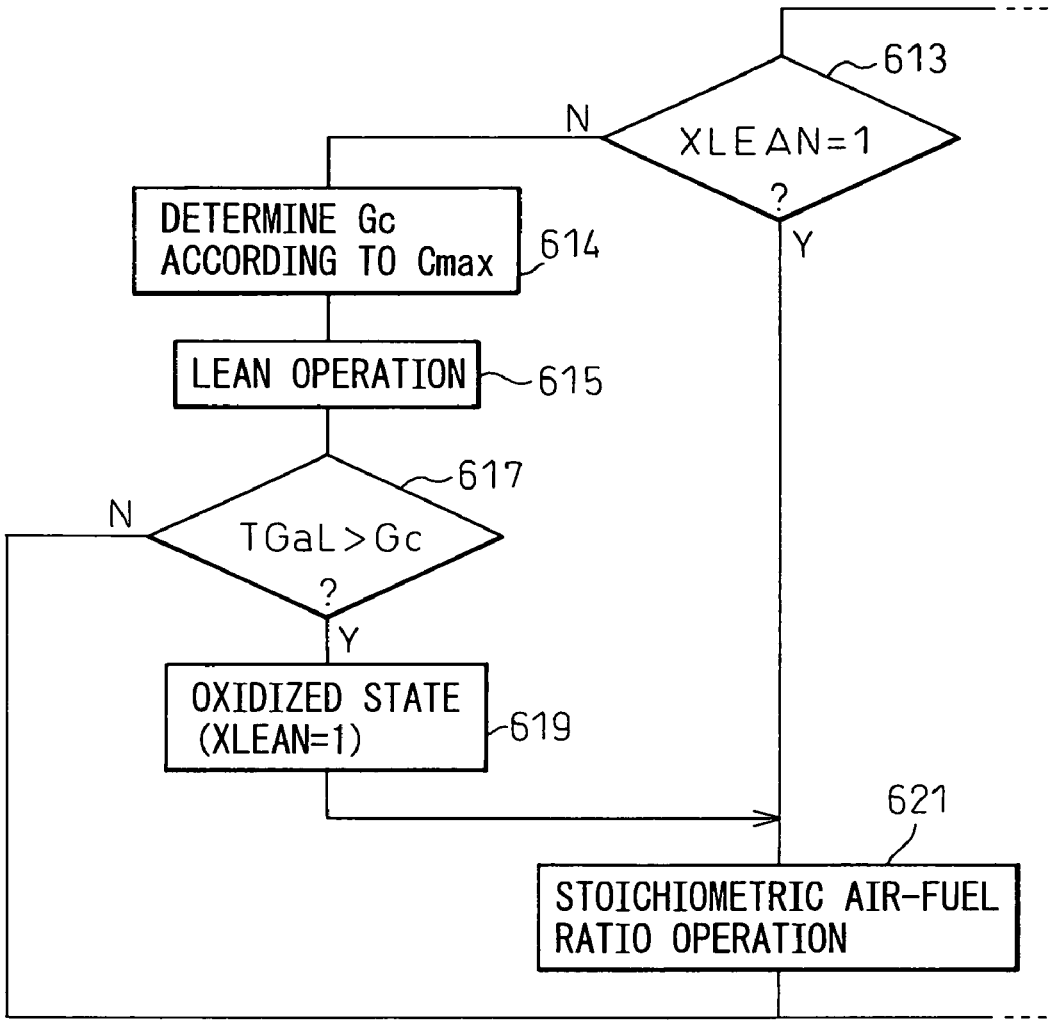
FIG. 9 is a flow chart of a control routine (partial) of operational control executed in still another embodiment of the present invention.

Next, referring to FIG. 9, a still further embodiment will be explained. In this embodiment, the greater the maximum amount of oxygen held Cmax of the catalyst, the longer the time for operating the engine so that the combustion air-fuel ratio becomes lean. FIG. 9 is a flow chart showing an example of (part of) the control routine for executing this operational control. By substituting this part shown in FIG. 9 for the part A surrounded by dotted lines of the control routine shown in FIG. 7, it is possible to obtain the overall control routine for executing the operational control of the present embodiment.

In the control routine shown in FIG. 9, the contents of the control of steps 613, 615, 617, 619, and 621 are substantially the same as the contents of the control of steps 413, 415, 417, 419, and 421 in the control routine shown in FIG. 7, respectively. As shown in FIG. 9, in the present embodiment as well, when it is judged at step 613 that the catalyst state flag XLEAN is 1, that is, the catalyst state is the oxidized state, the routine proceeds to step 621, where the engine is operated so that the combustion air-fuel ratio becomes the stoichiometric air-fuel ratio (stoichiometric air-fuel ratio operation) and the control routine is ended (more specifically the control routine is executed again from the start).

On the other hand, when it is judged at step 613 that the catalyst state flag XLEAN is not 1, that is, the catalyst state flag XLEAN is 0 and the catalyst state is the reduced state, the routine proceeds to step 614, where the cumulative value Gc of the amount of intake air Ga used as the criteria for judgment at the later explained step 617 is determined in accordance with the maximum amount of oxygen held Cmax of the catalyst. Note that as explained above, the maximum amount of oxygen held Cmax of the catalysts tends to become smaller the higher the degree of deterioration of the catalysts, so the determination of the cumulative value Gc at step 614 can be said to be a determination in accordance with the degree of deterioration of the catalysts.

Figure 10:
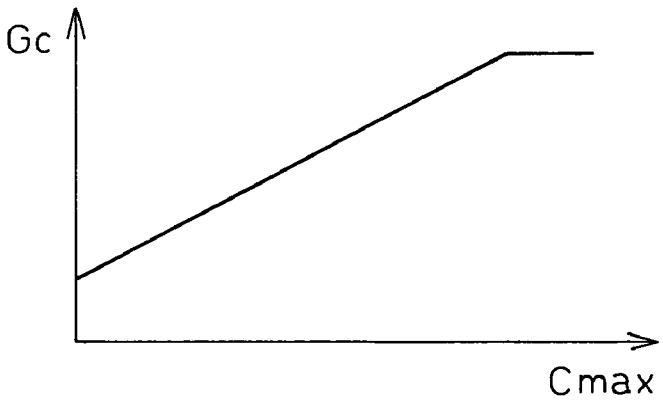
FIG. 10 is a map for finding a cumulative value Gc of an amount of intake gas used as a criteria for judgment at step 617 of FIG. 9 based on a maximum amount of oxygen held Cmax of the catalysts.

For the determination of this cumulative value Gc, for example the map shown in FIG. 10 is used. This is obtained by finding in advance suitable cumulative values Gc corresponding to the values of the maximum amount of oxygen held Cmax and mapping them. As shown by the map of FIG. 10, normally, the greater the maximum amount of oxygen held Cmax, the greater the cumulative value Gc in tendency. This is because the greater the maximum amount of oxygen held Cmax, the greater the amount of oxygen necessary until the catalyst state changes from the reduced state to the oxidized state.

Note that here the maximum amount of oxygen held Cmax can be estimated by various methods. That is, for example, when the engine is operated under a rich combustion air-fuel ratio after a fuel cut is executed and the catalyst state is made the oxidized state, it is possible to estimate this by measuring the time until the air-fuel ratio of the exhaust gas flowing out from the catalysts becomes rich after the start of rich operation. That is, in this case, the longer the time until the air-fuel ratio of the exhaust gas becomes rich, the greater the maximum amount of oxygen held Cmax estimated.

If the cumulative value Gc is determined at step 614, the routine proceeds to step 615, where the engine is operated so that the combustion air-fuel ratio becomes lean (lean operation), then the routine proceeds to step 617. At step 617, it is judged if the cumulative value TGaL of the amount of intake air after the start of lean operation is greater than the cumulative value Gc determined at step 614. Further, when it is judged at step 617 that the cumulative value TGaL is greater than the cumulative value Gc, the routine proceeds to step 619, where it is judged that the catalyst state is the oxidized state and the catalyst state flag XLEAN is made 1 (judgment of oxidized state). Further, in this case, the routine further proceeds to step 621, where the engine starts to be operated so that the combustion air-fuel ratio becomes the stoichiometric air-fuel ratio (stoichiometric air-fuel ratio operation) and the control routine ends (more specifically the control routine is executed again from the start). On the other hand, when it is judged at step 617 that the cumulative value TGaL is the cumulative value Gc or less, the control routine is ended as is, that is, in the state with the lean operation executed (more specifically the control routine is executed again from the start).

Further, here, the cumulative value Gc tends to become greater the greater the maximum amount of oxygen held Cmax as explained above, so when executing this control routine, the greater the maximum amount of oxygen held Cmax of the catalysts, the longer the time of operating the engine so that the combustion air-fuel ratio becomes lean; Further, the greater the maximum amount of oxygen held Cmax of the catalysts, the longer the time of the lean operation can be made, so the more reliably the catalysts can be changed to the oxidized state and the more reliably the generation of odor can be suppressed.

Figure 11:
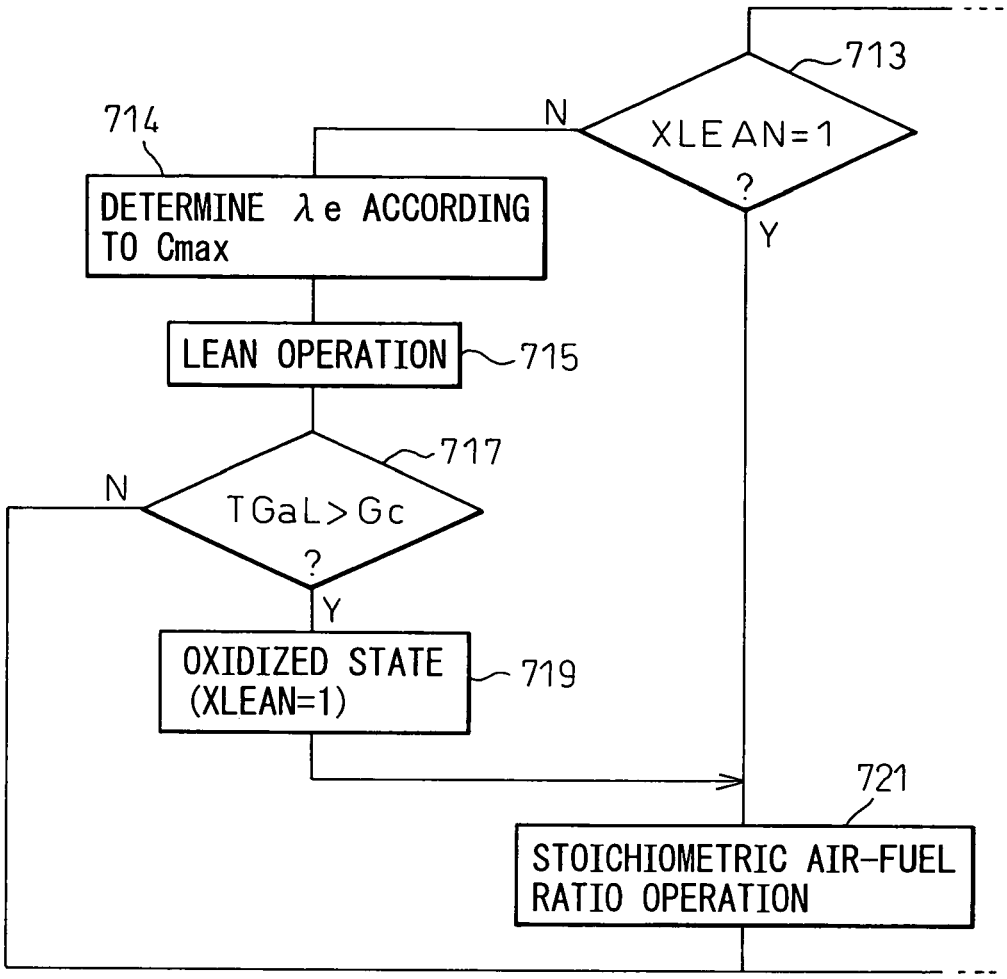
FIG. 11 is a flow chart of a control routine (partial) of operational control executed in still another embodiment of the present invention.

Next, referring to FIG. 11, a still further embodiment will be explained. In this embodiment, the greater the maximum amount of oxygen held Cmax of the catalysts, the greater the degree of leanness of the combustion air-fuel ratio when operating the engine so that the combustion air-fuel ratio becomes lean. FIG. 11 is a flow chart showing an example of (part of) the control routine for executing this operational control. By substituting this part shown in FIG. 11 for the part A surrounded by dotted lines of the control routine shown in FIG. 7, it is possible to obtain the overall control routine for executing the operational control of the present embodiment.

In the control routine shown in FIG. 11, the contents of the control of steps 713, 715, 717, 719, and 721 are substantially the same as the contents of the control of steps 413, 415, 417, 419, and 421 in the control routine shown in FIG. 7, respectively. As shown in FIG. 11, in the present embodiment as well, when it is judged at step 713 that the catalyst state flag XLEAN is 1, that is, the catalyst state is the oxidized state, the routine proceeds to step 721 where the engine is operated so that the combustion air-fuel ratio becomes the stoichiometric air-fuel ratio (stoichiometric air-fuel ratio operation) and the control routine is ended (more specifically the control routine is executed again from the start).

On the other hand, when it is judged at step 713 that the catalyst state flag XLEAN is not 1, that is, the catalyst state flag XLEAN is 0 and the catalyst state is the reduced state, the routine proceeds to step 714, where the combustion air-fuel ratio λe for when operating the engine so that the combustion air-fuel ratio becomes lean is determined in accordance with the maximum amount of oxygen held Cmax of the catalysts. Note that as explained above, the maximum amount of oxygen held Cmax of the catalysts tends to become smaller, the higher the degree of deterioration of the catalysts, so the determination of the combustion air-fuel ratio λe at step 714 can be said to be a determination in accordance with the degree of deterioration of the catalysts.

Figure 12:
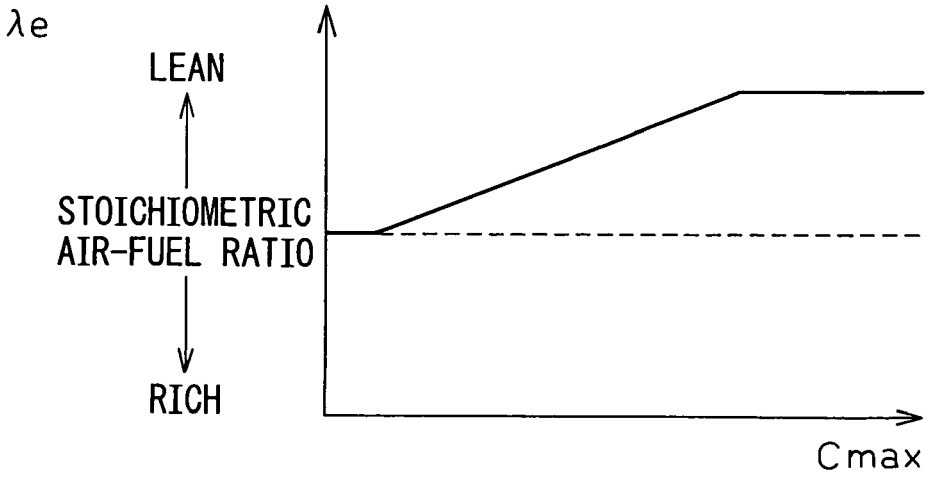
FIG. 12 is a map for finding a combustion air-fuel ratio λe when the engine is operated so that the combustion air-fuel ratio becomes lean based on the maximum amount of oxygen held Cmax of the catalysts.

For the determination of this combustion air-fuel ratio λe, for example the map shown in FIG. 12 is used. This is obtained by finding in advance suitable combustion air-fuel ratios λe corresponding to the values of the maximum amount of oxygen held Cmax and mapping them. As shown by the map of FIG. 12, normally, the greater the maximum amount of oxygen held Cmax, the larger the degree of leanness of the combustion air-fuel ratio λe in tendency. This is because the greater the maximum amount of oxygen held Cmax, the greater the amount of oxygen necessary until the catalyst state changes from the reduced state to the oxidized state, so to maintain the time until the catalyst state changes from the reduced state to the oxidized state sufficiently short, it is necessary to make the degree of leanness of the combustion air-fuel ratio λe larger.

If the combustion air-fuel ratio λe is determined at step 714, the routine proceeds to step 715, where a lean operation is performed so that the combustion air-fuel ratio becomes the combustion air-fuel ratio λe determined at step 714, then the routine proceeds to step 717. At step 717, it is judged if the cumulative value TGaL of the amount of intake air after the start of lean operation is greater than the predetermined cumulative value Gc. Further, when it is judged at step 717 that the cumulative value TGaL is greater than the cumulative value Gc, the routine proceeds to step 719, where it is judged that the catalyst state is the oxidized state and the catalyst state flag XLEAN is made 1 (judgment of oxidized state). Further, in this case, the routine further proceeds to step 721, where the engine starts to be operated so that the combustion air-fuel ratio becomes the stoichiometric air-fuel ratio (stoichiometric air-fuel ratio operation) and the control routine ends (more specifically the control routine is executed again from the start). On the other hand, when it is judged at step 717 that the cumulative value TGaL is the cumulative value Gc or less, the control routine is ended as is, that is, in the state with the lean operation in progress (more specifically the control routine is executed again from the start).

In this way, when executing this control routine, the greater the maximum amount of oxygen held Cmax of the catalysts, the greater the degree of leanness of the combustion air-fuel ratio when operating the engine so that the combustion air-fuel ratio becomes lean. Further, if doing this, the greater the maximum amount of oxygen held Cmax of the catalysts, the greater the amount of oxygen supplied to the catalysts, so the more reliably the catalyst state can be changed to the oxidized state and the more reliably the generation of odor can be suppressed.

Figure 13:
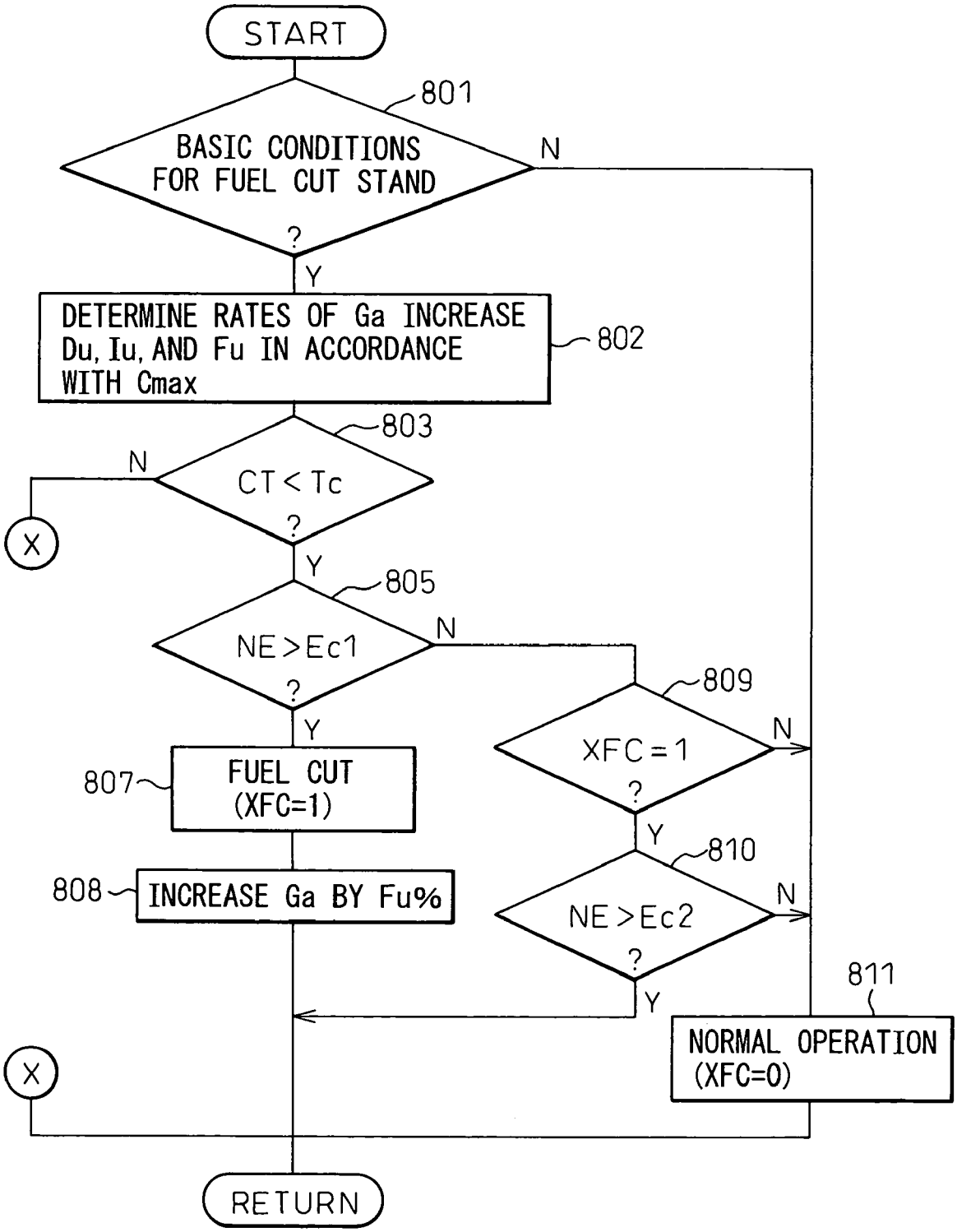
FIG. 13 is a flow chart of a control routine (partial) of operational control executed in still another embodiment of the present invention.

Next, referring to FIG. 13, a still further embodiment will be explained. In this embodiment, the greater the maximum amount of oxygen held Cmax of the catalysts, the greater the amount of intake air when operating the engine so that the combustion air-fuel ratio becomes lean and when executing a fuel cut. FIG. 13 is a flow chart showing an example of (part of) the control routine for executing this operational control. By inserting the (part of the) control routine shown in FIG. 8 between X-X of this (part of the) control routine shown in FIG. 13, it is possible to obtain the overall control routine for executing the operational control of the present embodiment.

In the control routine shown in FIG. 13, the contents of the control of steps 801, 803, 805, 809, 810, and 811 are substantially the same as the contents of the control of steps 401, 403, 405, 407, 409, 410, and 411 in the control routine shown in FIG. 7, respectively. As shown in FIG. 13, in the present embodiment, when it is judged at step 801 that the basic conditions of a fuel cut stand, the routine proceeds to step 802, where rates of increase Du, Iu, and Fu of the amount of intake air Ga used the case of operating the engine so that the combustion air-fuel ratio becomes the stoichiometric air-fuel ratio as normal are determined, in accordance with the maximum amount of oxygen held Cmax, for the case of lean operation in the decelerating state, the case of lean operation in the idling state, and the case of a fuel cut, respectively. Note that as explained above, the maximum amount of oxygen held Cmax tends to become smaller the higher the degree of deterioration of the catalysts, so the determination of the rates of increase Du, Iu, and Fu of the amount of intake air Ga at step 802 can be said to be determination in accordance with the degree of deterioration of the catalysts.

Figure 14:
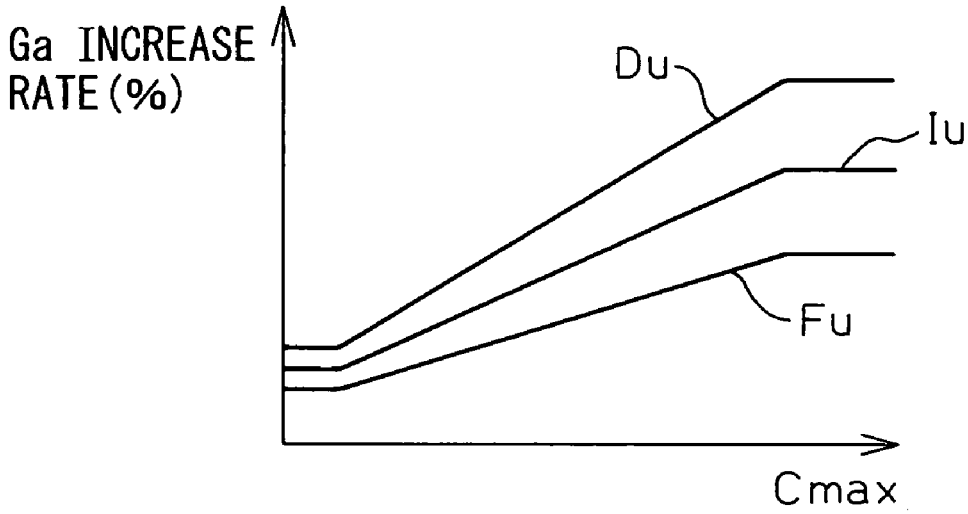
FIG. 14 is a map for finding rates of increase Du, Iu, and Fu of the amount of intake air Ga based on the maximum amounts of oxygen held Cmax of the catalysts.

For the determination of the rates of increase Du, Iu, and Fu of the amount of intake air Ga, for example the map shown in FIG. 14 is used. This is obtained by finding in advance suitable rates of increase Du, Iu, and Fu of the amount of intake air Ga corresponding to the values of the maximum amount of oxygen held Cmax and mapping them. As shown by the map of FIG. 14, normally, the greater the maximum amount of oxygen held Cmax, the larger the rates of increase Du, Iu, and Fu of the amount of intake air Ga tend to become. This is because the greater the maximum amount of oxygen held Cmax, the greater the amount of oxygen necessary until the catalyst state changes from the reduced state to the oxidized state, so to maintain the time until the catalyst state changes from the reduced state to the oxidized state sufficiently short, it is necessary to make the amount of intake air Ga larger.

Further, since this is probably clear from the explanation up to now and FIG. 13 and FIG. 8, a detailed explanation will be omitted, but in the present embodiment, the amount of intake air Ga is increased in accordance with the rates of increase Du, Iu, and Fu of the amount of intake air Ga determined at step 802, at the time of lean operation in the decelerating state at the time of lean operation in the idling state, and at the time of a fuel cut, respectively (steps 514*b*, 514*c*, and 808).

As a result, when executing this control routine, the greater the maximum amount of oxygen held Cmax of the catalysts, the greater the amount of intake air when operating the engine so that the combustion air-fuel ratio becomes lean and when executing a fuel cut. Further, by doing this, the greater the maximum amount of oxygen held Cmax of the catalysts, the greater the oxygen supplied to the catalysts, so the more reliably the catalyst state can be changed to the oxidized state and the more reliably the generation of odor can be suppressed.

Note that in this embodiment, when the routine proceeds to step 811, where normal operation is started, in the state of executing control for increasing the amount of intake air Ga, only naturally the control for increasing the amount of intake air Ga is suspended when starting the normal operation.

Further, here, the explanation was given using as an example the case of increase of the amount of intake air Ga in accordance with the maximum amount of oxygen held Cmax both when operating the engine so that the combustion air-fuel ratio becomes lean and when executing a fuel cut, but it is also possible to increase the amount of intake air Ga as explained above only when operating the engine so that the combustion air-fuel ratio becomes lean.

Further, when the exhaust gas purification system 10 has the configuration such as shown in FIG. 3*c*, it is also possible to determine the rates of increase Du, Iu, and Fu of the amount of intake air Ga in accordance with the maximum amount of oxygen held Cmaxd of the downstream catalyst 20 after the output of the middle air-fuel ratio sensor 15 indicates that the air-fuel ratio is lean.

Figure 15:
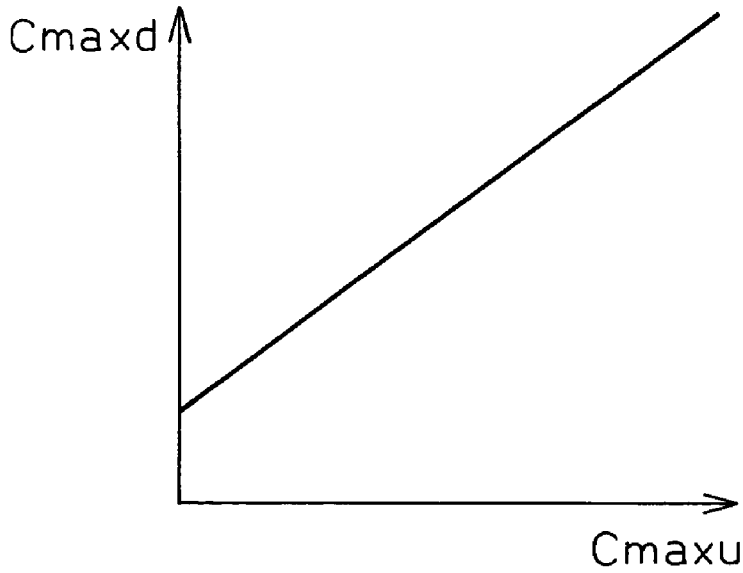
FIG. 15 is a map for estimating a maximum amount of oxygen held Cmaxd of the downstream side catalyst from the maximum amount of oxygen held Cmaxu of the upstream side catalyst.

Further, in this case, it is also possible to estimate the maximum amount of oxygen held Cmaxd of the downstream catalyst 20 from the maximum amount of oxygen held Cmaxu of the upstream catalyst 18. That is, in general, the downstream catalyst 20 becomes lower in temperature than the upstream catalyst 18, so when using the same types of catalysts, the degree of deterioration of the downstream catalyst 20 becomes lower than the degree of deterioration of the upstream catalyst. Therefore, the maximum amount of oxygen held Cmaxd of the downstream catalyst 20 becomes somewhat greater than the maximum amount of oxygen held Cmaxu of the upstream catalyst 18. If mapping this, the result becomes as shown in for example FIG. 15. Further, if preparing such a map in advance, it is possible to estimate the maximum amount of oxygen held Cmaxd of the downstream catalyst 20 from the maximum amount of oxygen held Cmaxu of the upstream catalyst 18.

Figure 16:
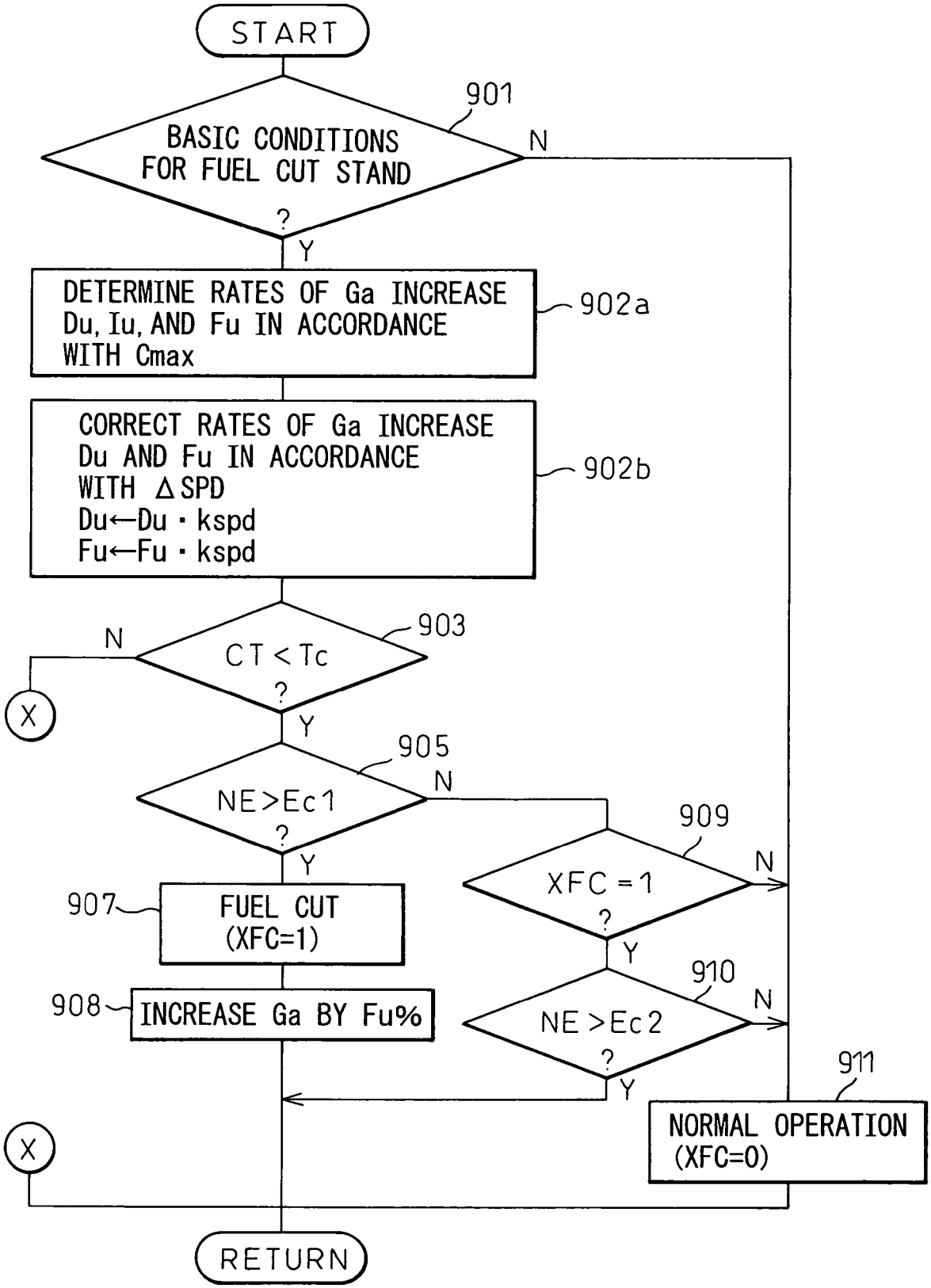
FIG. 16 is a flow chart of a control routine (partial) of operational control executed in still another embodiment of the present invention.

Next, referring to FIG. 16, a still further embodiment will be explained. In this embodiment, the greater the degree of deceleration in the decelerating state of the vehicle, the greater the amount of intake air is made when operating the engine so that the combustion air-fuel ratio becomes lean and when executing a fuel cut. FIG. 16 is a flow chart showing an example of (part of) the control routine for executing this operational control. By introducing the (part of the) control routine shown in FIG. 8 between X-X of the (part of the) control routine shown in FIG. 16, it is possible to obtain the overall control routine for executing the operational control of the present embodiment.

Referring to FIG. 16, this control routine is substantially the same as the control routine shown in FIG. 13 and differs on only the point of provision of step 902*b* after step 902*a* corresponding to step 802 of FIG. 13. At step 902*b*, the degree of speed change (acceleration) ΔSPD is found. In accordance with this degree of speed change ΔSPD, the rate of increase Du of the amount of intake air Ga in the case of lean operation in the decelerating state and the rate of increase Fu of the amount of intake air Ga in the case of executing a fuel cut, determined at step 902*a*, are corrected. More specifically, the rates of increase Du and Fu of the amount of intake air Ga determined at step 902*a* are multiplied with the correction coefficient kspd determined in accordance with the degree ΔSPD of the speed change to find the rates of increase Du and Fu after correction.

Figure 17:
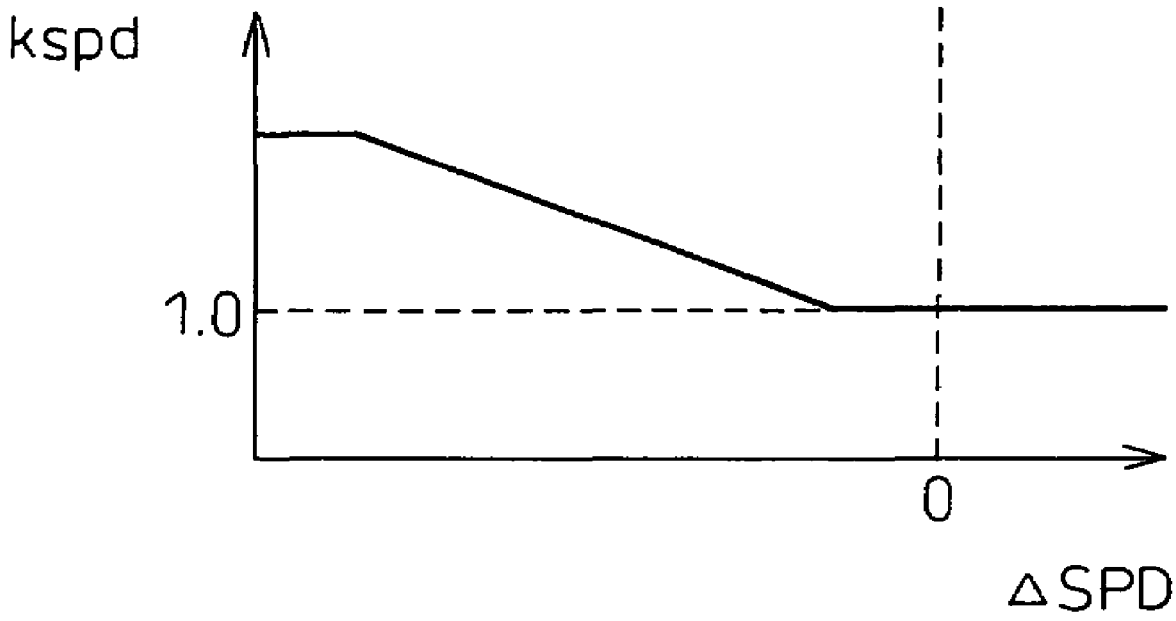
FIG. 17 is a map for finding a correction coefficient kspd used at step 902*b* of FIG. 16.

Here, the correction coefficient kspd is for example determined using the map such as shown in FIG. 17. This is obtained by finding in advance suitable correction coefficients kspd corresponding to different values of the degree ΔSPD of the speed change and mapping them. As shown by the map of FIG. 17, normally the smaller the value of the degree ΔSPD of the speed change, that is, the greater the degree of deceleration, the greater the correction coefficient kspd in tendency. This is because the greater the degree of deceleration, the shorter the time in which the vehicle can be stopped, so it is necessary to increase the amount of oxygen supplied and change the catalyst state from the reduced state to the oxidized state faster for reliably suppressing the generation of odor.

Further, as clear from FIG. 16 and FIG. 8, in the present embodiment, the amount of intake air Ga is increased in the case of lean operation in the decelerating state and the case of executing a fuel cut (steps 514*b* and 908) in accordance with the rates of increase Du and Fu of the amount of intake air Ga corrected at step 902*b*, respectively.

As a result, when executing this control routine, the greater the degree of deceleration in the decelerating state of the vehicle, the greater the amount of intake air when operating the engine so that the combustion air-fuel ratio becomes lean and when executing a fuel cut. Further, by doing this, the greater the degree of deceleration in the decelerating state, the faster the catalyst state can be changed to the oxidized state and the more reliably the generation of odor can be suppressed.

Note that in this embodiment as well, when the routine proceeds to step 911, where normal operation is started, in the state of executing control for increasing the amount of intake air Ga, only naturally the control for increasing the amount of intake air Ga is suspended when starting the normal operation.

Further, here, the explanation was given using as an example the case of increase of the amount of intake air Ga in accordance with the degree of deceleration in the above decelerating state both when operating the engine so that the combustion air-fuel ratio becomes lean and when executing a fuel cut, but it is also possible to increase the amount of intake air Ga as explained above only when operating the engine so that the combustion air-fuel ratio becomes lean.

Further, by the same thinking as in the present embodiment, the greater the degree of deceleration in the decelerating state of the vehicle, the greater the degree of leanness of the combustion air-fuel ratio may be made when operating the engine so that the combustion air-fuel ratio becomes lean. Since this is probably clear from the explanation up to now, a detailed explanation will be omitted, but even by doing this, the greater the degree of deceleration in the decelerating state, the faster the catalyst state can be changed to the oxidized state and the more reliably the generation of odor can be suppressed.

Figure 18:
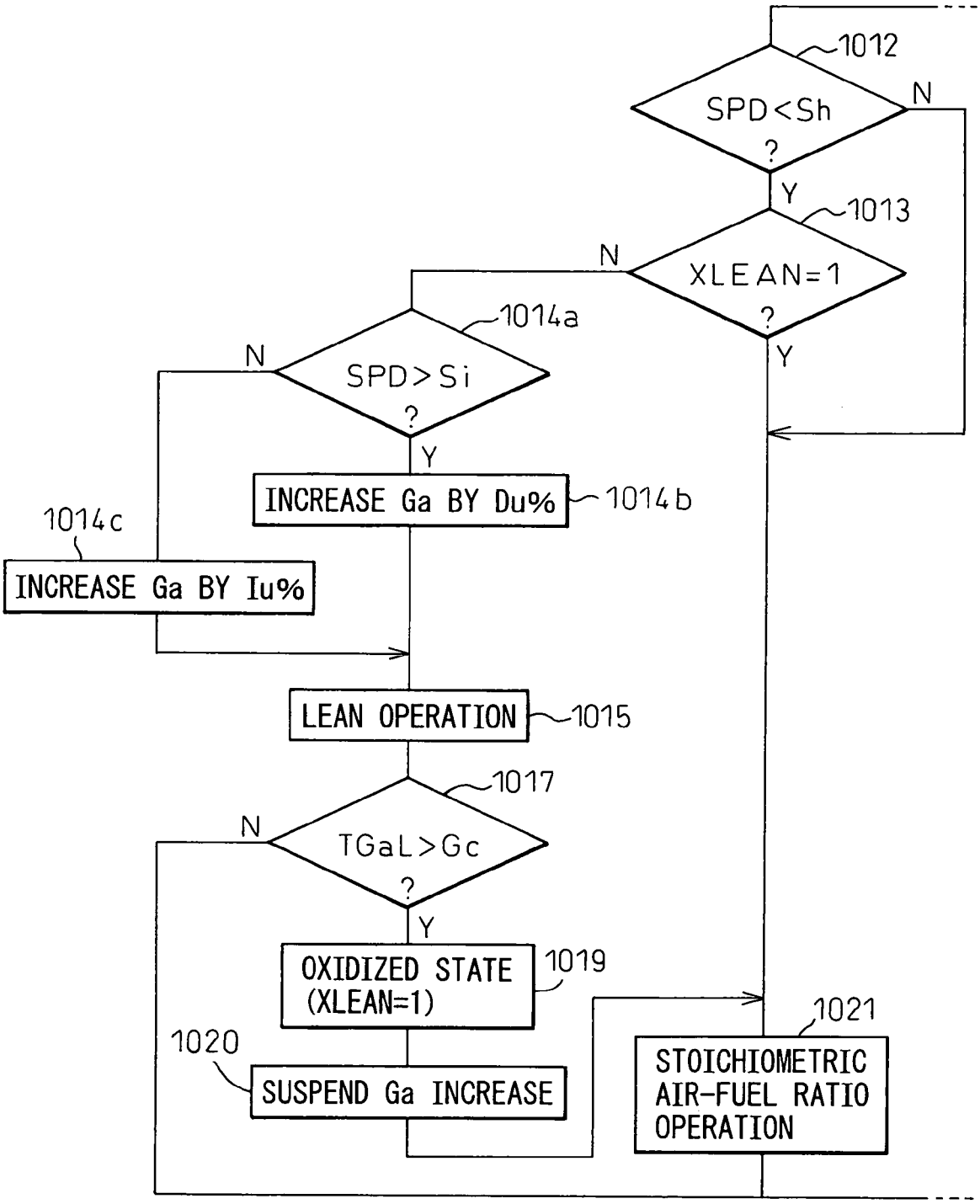
FIG. 18 is a flow chart of a control routine (partial) of operational control executed in still another embodiment of the present invention.

Next, referring to FIG. 18, still another embodiment will be explained. In this embodiment, the engine is operated so that the combustion air-fuel ratio becomes lean only when the vehicle speed is less than a predetermined vehicle speed. FIG. 18 is a flow chart showing an example of (part of) the control routine for executing this operational control. By substituting the part shown in FIG. 18 for the part A surrounded by the dotted lines of the control routine shown in FIG. 7, it is possible to obtain the entire control routine for executing the operational control of the present embodiment.

Referring to FIG. 18, this control routine is substantially the same as the control routine shown in FIG. 8 and differs only on the point of provision of step 1012 before step 1013 corresponding to step 513 of FIG. 8. At step 1012, it is judged if the current vehicle speed SPD is less than the predetermined vehicle speed Sh. Here, the predetermined vehicle speed Sh is for judging if the current vehicle speed is a high enough speed that a relatively long time is taken until the vehicle stops, for example, is 60 km/h.

At step 1012, when it is judged that the vehicle speed SPD is the predetermined vehicle speed Sh or more, the vehicle speed is deemed to be relatively high and the routine proceeds to step 1021, where the engine is operated so that the combustion air-fuel ratio becomes the stoichiometric air-fuel ratio (stoichiometric air-fuel ratio operation), then the control routine is ended (more specifically, the control routine is executed from the start again). That is, in this case, the engine is not operated so that the combustion air-fuel ratio becomes lean. On the other hand, when it is judged at step 1012 that the vehicle speed SPD is less than the predetermined vehicle speed Sh, the routine proceeds to step 1013, where it is judged if the catalyst state flag XLEAN is 1or not. Further, here, when it is judged that the catalyst state flag XLEAN is not 1, that is, the catalyst state flag XLEAN is 0 and the catalyst state is the reduced state, the engine is operated so that the combustion air-fuel ratio becomes lean.

In this way, in the present embodiment, the engine is operated so that the combustion air-fuel ratio becomes lean only when the vehicle speed is less than the predetermined vehicle speed Sh. Further, by doing this, it is possible to suppress catalyst deterioration even more and suppress generation of odor.

That is, if the engine is operated so that the combustion air-fuel ratio becomes lean, the catalyst is supplied with oxygen, so catalyst deterioration is liable to be caused. Therefore, the engine is preferably operated so that the combustion air-fuel ratio becomes lean the minimum necessary extent of time from the viewpoint of suppression of generation of odor.

Further, from the viewpoint of the suppression of generation of odor, the operation of the engine so that the combustion air-fuel ratio becomes lean has to be performed so that the catalyst state becomes the oxidized state before the vehicle is stopped. Therefore, when the vehicle speed is relatively high, even in the decelerating state, this operation does not necessarily have to be performed. It is sufficient to enable the catalyst state to be changed to the oxidized state before the vehicle is stopped when the vehicle speed has fallen a certain extent. Further, by preventing operation of the engine so that the combustion air-fuel ratio becomes lean when the vehicle speed is relatively high, for example, when the accelerator is temporarily released at the time of high speed operation etc., it is possible to suppress the engine being operated so that the combustion air-fuel ratio becomes lean, the catalyst being wastefully supplied with oxygen, and the catalyst being deteriorated.

From the above, according to the present embodiment, by suitably setting the predetermined vehicle speed Sh, it is possible to suppress the catalyst deterioration even more and suppress the generation of odor. Note that in this embodiment as well, when the routine proceeds to the step corresponding to step 411 of FIG. 7 in the state with control for increasing the amount of intake air Ga executed and normal operation is started, only naturally the control for increasing the amount of intake air Ga is suspended when starting normal operation.

Next, referring to FIG. 19, a still further embodiment will be explained. When the amount of intake air is increased when operating the engine so that the combustion air-fuel ratio becomes lean like in the above embodiment, an increase in the generated torque, a rise in the engine speed, etc. occur and deterioration of the decelerating characteristic or a rise of the idling speed is liable to be caused. To suppress this, in the present embodiment, when operating the engine so that the combustion air-fuel ratio becomes lean, the ignition timing is made to be retarded when the amount of intake air is increased over the case of operating the engine so that the combustion air-fuel ratio becomes the stoichiometric air-fuel ratio. That is, in the present embodiment, when operating the engine so that the combustion air-fuel ratio becomes lean and the amount of intake air is increased, the ignition timing is retarded so that the combustion deteriorates and the deterioration of the deceleration characteristic and the rise of the idling speed are suppressed.

Figure 19:
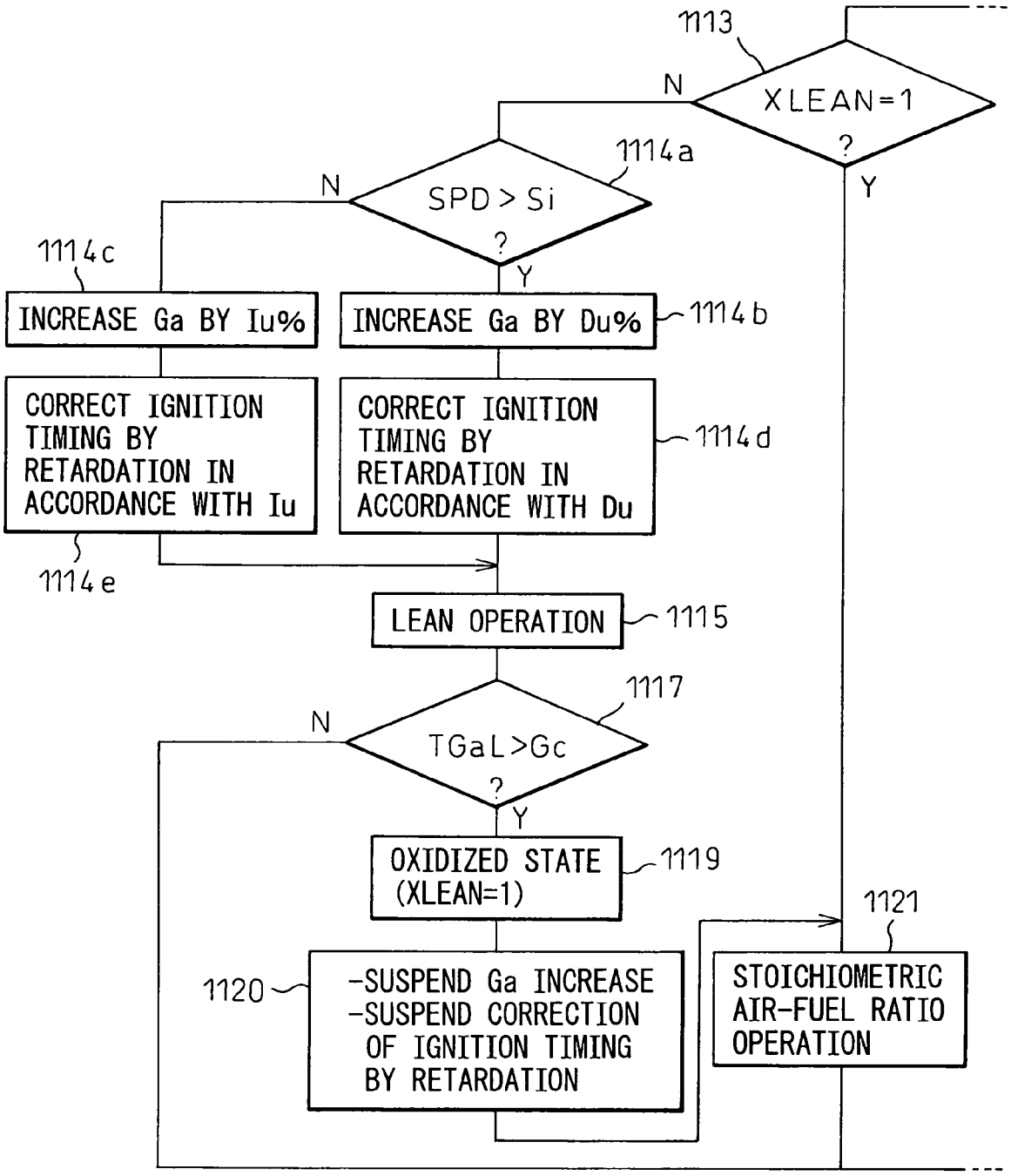
FIG. 19 is a flow chart of a control routine (partial) of operational control executed in still another embodiment of the present invention.

FIG. 19 is a flow chart showing an example of (part of) the control routine executing such operational control. By substituting the part shown by FIG. 19 for the part A surrounded by the dotted line in the control routine shown in FIG. 7 or by incorporating it between X-X of (part of) the control routine shown in FIG. 13 or FIG. 16, it is possible to obtain all of the control routine for executing the operational control of the present embodiment.

Referring to FIG. 19, this control routine is substantially the same as the control routine shown in FIG. 8 and differs on the point of provision of step 1114*d* after step 1114*b* corresponding to step 514*b* of FIG. 8, the point of provision of step 1114*e* after step 1114*c* corresponding to step 514*c* of FIG. 8, and the point of suspension of control for increasing the amount of intake air Ga and also suspension of the control for correcting the ignition timing by retardation at step 1120 corresponding to step 520 of FIG. 8.

In the above steps 1114*d* and 1114*e*, the control for correcting the ignition timing by retardation in accordance with the rate of increase Du or Iu of the control for increasing the amount of intake air Ga started at the preceding step is started. As a result, in this embodiment, the ignition timing is retarded in accordance with the rate of increase Du or Iu of the control for increasing the amount of intake air Ga during lean operation.

Figure 20A:
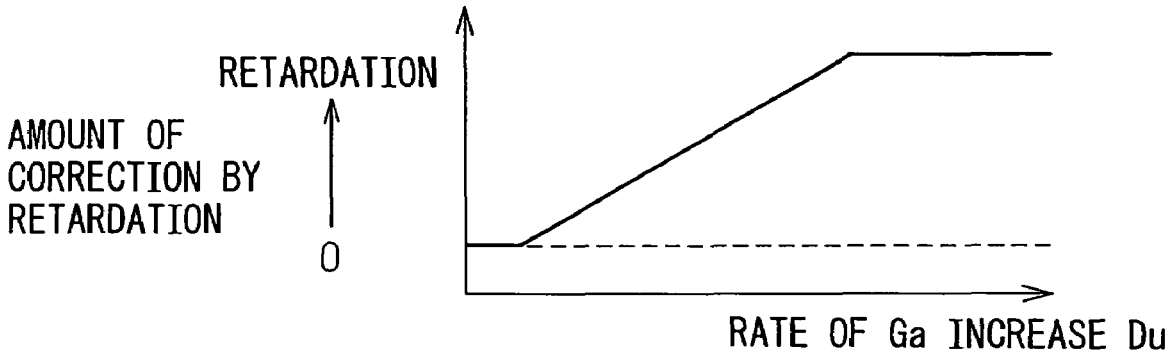
FIG. 20*a* is a map for finding an amount of correction of ignition timing by retardation based on a rate of increase Du of the amount of intake air Ga.
Figure 20B:
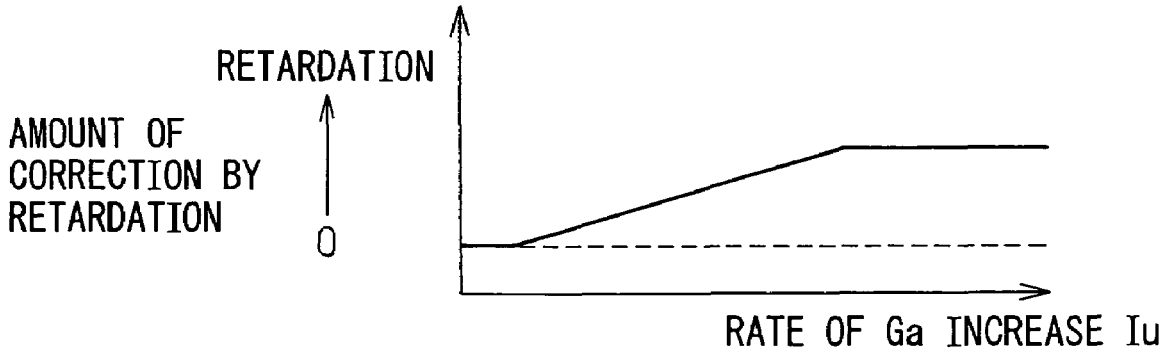
FIG. 20*b* is a map for finding an amount of correction of ignition timing by retardation based on a rate of increase Iu of the amount of intake air Ga.

Note that here the amount of correction of the control for correction of the timing by retardation can be determined using the maps as shown in FIG. 20*a* and FIG. 20*b*. These are obtained by finding in advance the suitable amounts of correction of the control for correction of the timing by retardation (amounts of correction by retardation) corresponding to the different values of the rates of increase Du and Iu of the amount of intake air Ga and forming them into maps. FIG. 20*a* is for the rate of increase Du of the amount of intake air Ga when in the decelerating state, while FIG. 20*b* is for the rate of increase Iu of the amount of intake air Ga when in the idling state. As shown by the maps of FIG. 20*a* and FIG. 20*b*, normally the greater the rates of increase Du and Iu of the amount of intake air Ga, the greater the amount of correction by retardation (that is, the greater the retardation). This is because the greater the rates of increase Du and Iu of the amount of intake air, the greater the degree of increase of the torque generated along with this and the rise of the engine speed, so it is necessary to make the amount of correction of the ignition timing by retardation larger so as to suppress this.

As shown above, when executing this control routine, the ignition timing is retarded in accordance with the rate of increase Du or Iu of the control for increasing the amount of intake air G during lean operation. Due to this, deterioration of the deceleration property or a rise of the idling speed accompanying control for increasing the amount of intake air Ga can be suppressed.

Note that in this embodiment, when the routine proceeds to a step corresponding to step 411 of FIG. 7 or step 811 of FIG. 13 or step 911 of FIG. 16 in a state executing control for increasing the amount of intake air Ga and control for correcting the ignition timing by retardation, only naturally the control for increasing the amount of intake air Ga and the control for correcting the ignition timing by retardation are suspended at the time of start of normal operation.

Figure 21:
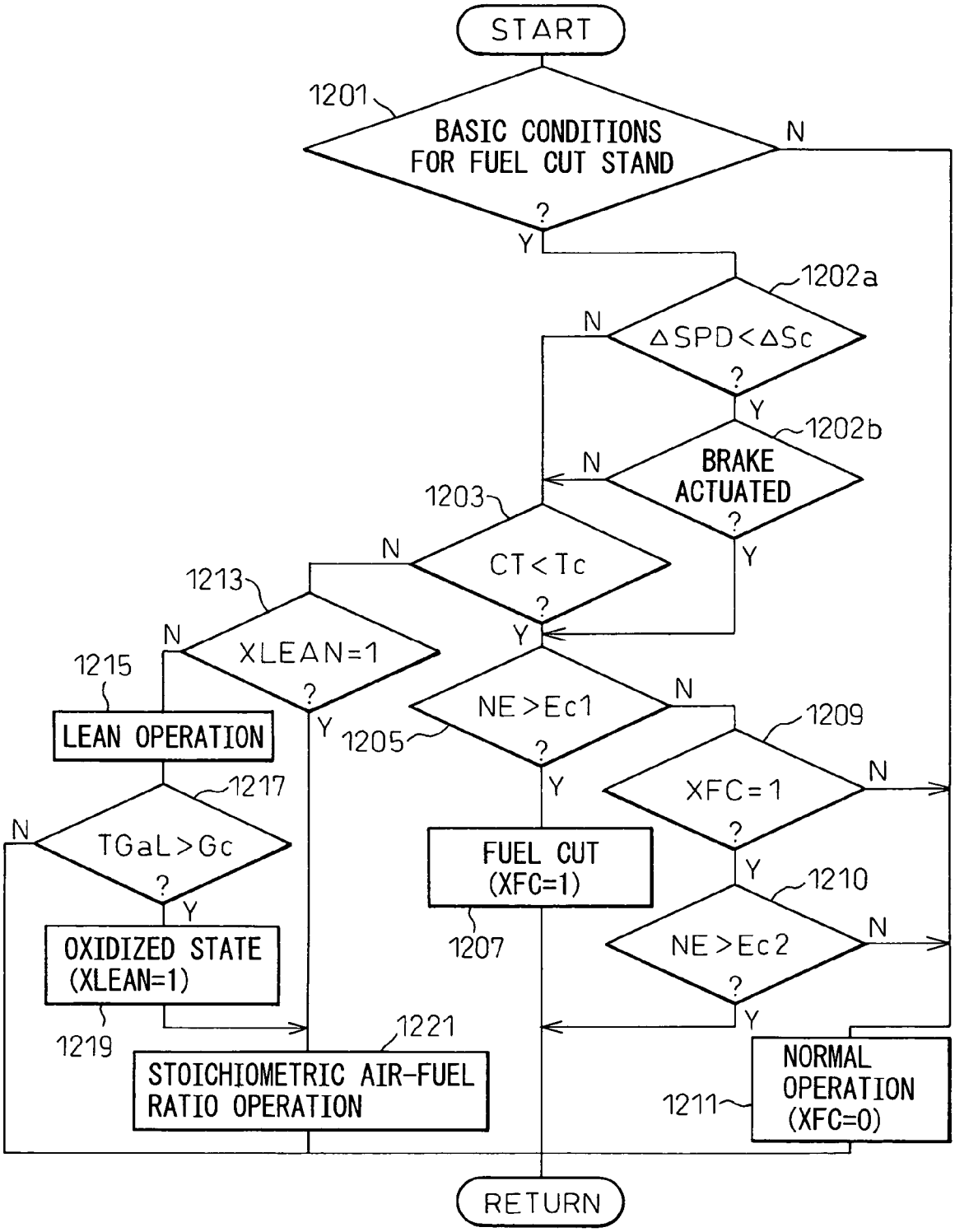
FIG. 21 is a flow chart of a control routine of operational control executed in still another embodiment of the present invention.

Next, referring to FIG. 21, a still further embodiment will be explained. In this embodiment, when the degree of deceleration in the decelerating state of the vehicle is larger than a predetermined degree of deceleration, prohibition of a fuel cut based on the catalyst temperature is prevented. FIG. 21 is a flow chart showing an example of a control routine for executing such operational control. Referring to FIG. 21, this control routine is substantially the same as the control routine shown in FIG. 7 and differs on the point of the provision of the step 1202*a* and step 1202*b* after the step 1201 corresponding to the step 401 of FIG. 7.

At the above step 1202*a*, it is judged if the current value of the degree ΔSPD of speed change is smaller than a predetermined degree ΔSc of speed change, that is, if the current degree of deceleration is larger than the predetermined degree of deceleration. When it is judged at step 1202*a* that the current degree of deceleration is smaller than the predetermined degree of deceleration (that is, the deceleration is not that rapid), the routine proceeds to step 1203 corresponding to step 403 of FIG. 7 where it is judged if a fuel cut can be executed based on the catalyst temperature CT.

On the other hand, when it is judged at step 1202*a* that the current degree of deceleration is larger than the predetermined degree of deceleration (that is, rapid deceleration), the routine next proceeds to step 1202*b*, where it is judged if the brake is being actuated. When it is judged at step 1202*b* that the brake is not being actuated, the routine proceeds to step 1203, where it is judged if a fuel cut can be executed based on the catalyst temperature CT.

On the other hand, when it is judged at step 1202*b* that the brake is being actuated, it is judged that the driver has the intention of stopping the vehicle, step 1203 is skipped, and the routine proceeds to step 1205 corresponding to step 403 of FIG. 7. That is, in this case, it is not judged if a fuel cut can be executed based on the catalyst temperature CT (step 1203). Only the next stage, that is, the judgment of whether the fuel cut can be executed based on the engine speed NE (step 1205), is performed. Therefore, in this case, even if the catalyst temperature CT is the predetermined temperature Tc or more, a fuel cut is not prohibited.

In this way, in the present embodiment, when the degree of deceleration in the decelerating state of the vehicle is larger than a predetermined degree of deceleration, a fuel cut based on the catalyst temperature CT is not prohibited. By doing this, when the degree of deceleration of the vehicle is large and the time until stopping the vehicle is short, the fuel cut is executed regardless of the catalyst temperature CT and the catalyst state is changed to the oxidized state faster, so odor can be suppressed more reliably.

Note that step 1202*b* in this embodiment is a step for reconfirming the intention of the driver to stop the vehicle and can be omitted. However, if inserting the above step 1202*b* and not prohibiting the fuel cut based on the catalyst temperature CT only when the brake is being actuated among the cases of rapid deceleration, since the time a fuel cut is executed regardless of the catalyst temperature CT will necessarily be the case of rapid deceleration by braking, there is the advantage that the torque shock accompanying the fuel cut will hardly be felt.

Next, referring to FIG. 22, still another embodiment will be explained. In this embodiment, when the engine speed fluctuation in the case of operating the engine so that the combustion air-fuel ratio becomes lean is larger than the predetermined speed fluctuation, the engine is switched to operation so that the combustion air-fuel ratio becomes the stoichiometric air-fuel ratio.

Figure 22:
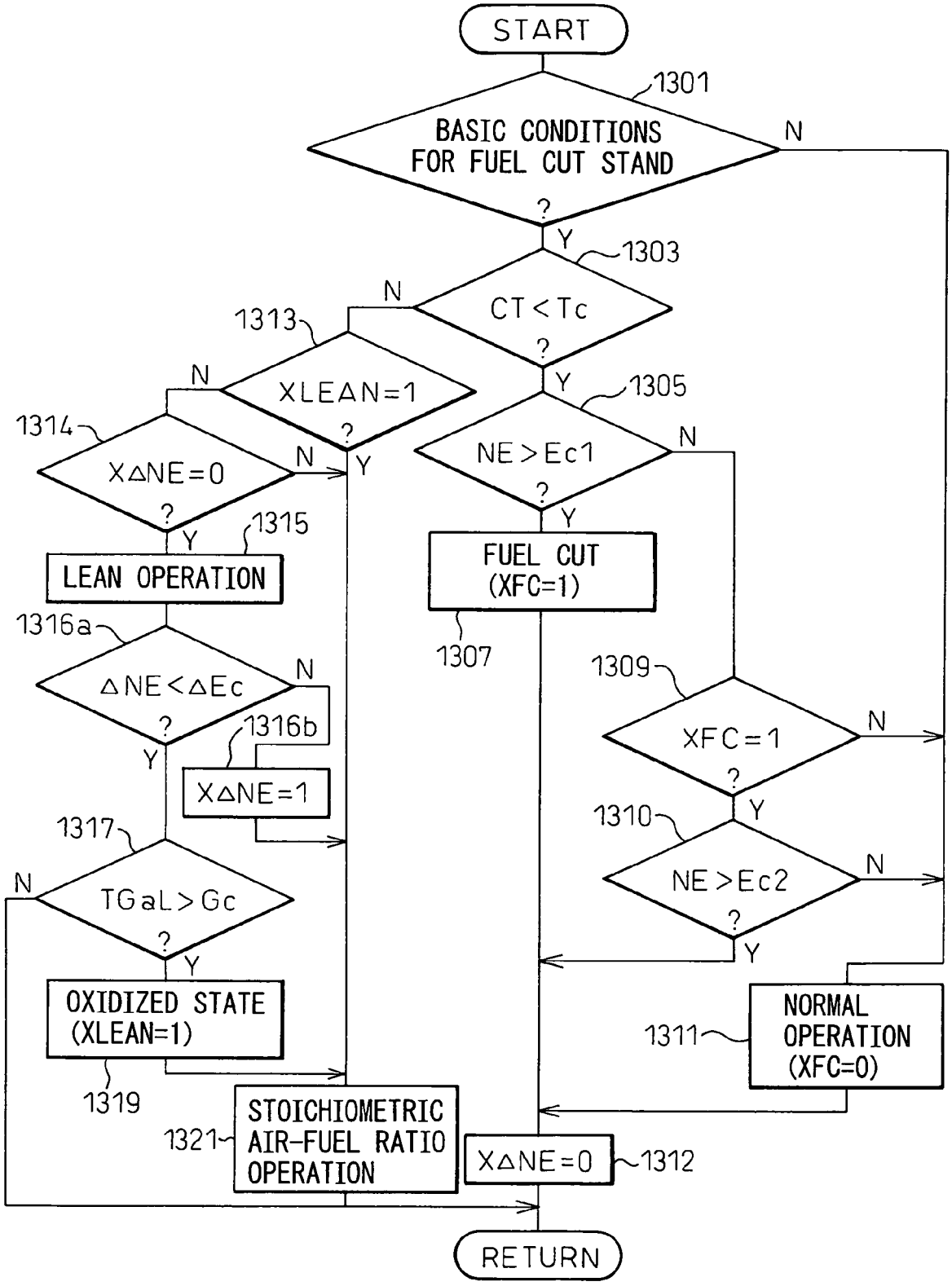
FIG. 22 is a flow chart of a control routine of operational control executed in still another embodiment of the present invention.

FIG. 22 is a flow chart showing an example of the control routine for executing such operational control. Referring to FIG. 22, this control routine is substantially the same as the control routine shown in FIG. 7 and differs in the point of the provision of the steps 1314, 1316*a*, and 1316*b* before and after the step 1315 corresponding to step 415 of FIG. 7 and in the point of the provision of the step 1312 at a part after the steps 1307, 1310, and 1311 corresponding to steps 407, 410, and 411 of FIG. 7.

As shown in FIG. 22, in this embodiment, when the catalyst state flag XLEAN is not 1 at step 1313, that is, when the catalyst state flag XLEAN is 0 and it is judged that the catalyst state is the reduced state, the routine proceeds to step 1314, where it is judged if the speed fluctuation flag XΔNE is 0 or not. The speed fluctuation flag XΔNE, simply stated, shows if the speed fluctuation ΔNE of the internal combustion engine in the case of operating the engine so that the combustion air-fuel ratio becomes lean is in the allowable range. More specifically, in the case of this embodiment, this speed fluctuation flag XΔNE is made 1 at the later explained step 1316*b* when the speed fluctuation ΔNE of the internal combustion engine in the case of operating the engine so that the combustion air-fuel ratio becomes lean is the predetermined speed fluctuation ΔEc showing the allowable range or more. When a fuel cut is executed or when normal operation is performed etc., the control proceeds from either of the above steps 1307, 1310, and 1311 to step 1312, where the flag is made 0.

When it is judged at step 1314 that the speed fluctuation flag XΔNE is not 0, that is, the speed fluctuation flag XΔNE is 1 (that is, when it has been judged, by then, that the speed fluctuation ΔNE of the internal combustion engine in the case of operating the engine so that the combustion air-fuel ratio becomes lean is not in the allowable range), the routine proceeds to step 1321, where the engine is operated so that the combustion air-fuel ratio becomes the stoichiometric air-fuel ratio (stoichiometric air-fuel ratio operation) and the control routine ends (more specifically, the control routine is executed again from the start).

On the other hand, when it is judged at step 1314 that the speed fluctuation flag XΔNE is 0, the routine proceeds to step 1315, where the engine is operated so that the combustion air-fuel ratio becomes lean (lean operation). Further, in the state with the lean operation performed, the routine proceeds to step 1316*a*, where it is judged if the speed fluctuation ΔNE of the internal combustion engine at that time is less than the predetermined speed fluctuation ΔEc.

When it is judged at step 1316*a* that the speed fluctuation ΔNE is less than the predetermined speed fluctuation ΔEc forming the criteria of judgment, the routine proceeds to step 1317 corresponding to step 417 of FIG. 4. In this case, at step 1317, the above lean operation is continued so long as it is not judged at step 1317 that the cumulative value TGaL of the amount of intake air after the start of the lean operation is larger than the predetermined cumulative value Gc of the amount of intake air.

On the other hand, when it is judged at step 1316*a* that the speed fluctuation ΔNE is the predetermined speed fluctuation ΔEc serving as the criteria of judgment or more, the routine proceeds to step 1316*b*, where the speed fluctuation flag XΔNE is made 1. Further, the routine proceeds to step 1321, where the above stoichiometric air-fuel ratio operation is performed and the control routine is ended (more specifically, the control routine is executed again from the start). That is, in this case, the above lean operation is prohibited and the engine is switched from the above lean operation to the above stoichiometric air-fuel ratio operation.

As explained above, when executing the control routine, when the engine speed fluctuation ΔNE when operating the engine so that the combustion air-fuel ratio becomes lean is larger than the predetermined speed fluctuation ΔEc, the operation of the engine is switched to operation so that the combustion air-fuel ratio becomes the stoichiometric air-fuel ratio. By doing this, it is possible to prevent misfires and stalling accompanying operation of the engine so that the combustion air-fuel ratio becomes lean.

While the invention has been described with reference to specific embodiments chosen for purpose of illustration, it should be apparent that numerous modifications could be made thereto by those skilled in the art without departing from the basic concept and scope of the invention.

The invention claimed is:

1. A control device of an internal combustion engine provided with fuel cut executing means for executing a fuel cut for stopping the supply of fuel to an internal combustion engine mounted in a vehicle when said vehicle is in a decelerating state and fuel cut prohibiting means for prohibiting a fuel cut executed by said fuel cut executing means when a temperature of a catalyst provided in an exhaust system of said internal combustion engine is a predetermined temperature or more, wherein when a fuel cut is prohibited by said fuel cut prohibiting means when the vehicle decelerates in a predetermined period after an increased fuel operation is performed for operating said internal combustion engine so that a combustion air-fuel ratio becomes rich, the internal combustion engine is operated so that the combustion air-fuel ratio becomes lean in said decelerating state or in said decelerating state and its succeeding idling state, wherein catalysts are provided separately at two locations in series in the exhaust system of said internal combustion engine and said predetermined period is deemed to have elapsed when it is judged that even the catalyst provided at the downstream side is in an oxidized state where said catalyst holds sufficient oxygen.

2. A control device of an internal combustion engine provided with fuel cut executing means for executing a fuel cut for stopping the supply of fuel to an internal combustion engine mounted in a vehicle when said vehicle is in a decelerating state and fuel cut prohibiting means for prohibiting a fuel cut executed by said fuel cut executing means when a temperature of a catalyst provided in an exhaust system of said internal combustion engine is a predetermined temperature or more, wherein when a fuel cut is prohibited by said fuel cut prohibiting means when the vehicle decelerates in a predetermined period after an increased fuel operation is performed for operating said internal combustion engine so that a combustion air-fuel ratio becomes rich, the internal combustion engine is operated so that the combustion air-fuel ratio becomes lean in said decelerating state or in said decelerating state and its succeeding idling state, wherein the greater the maximum amount of oxygen held in said catalyst, the longer the time when the engine is operated so that said combustion air-fuel ratio becomes lean is made, or the greater the degree of leanness of the combustion air-fuel ratio or the greater the amount of intake air when the engine is operated so that said combustion air-fuel ratio becomes lean.

3. A control device of an internal combustion engine provided with fuel cut executing means for executing a fuel cut for stopping the supply of fuel to an internal combustion engine mounted in a vehicle when said vehicle is in a decelerating state and fuel cut prohibiting means for prohibiting a fuel cut executed by said fuel cut executing means when a temperature of a catalyst provided in an exhaust system of said internal combustion engine is a predetermined temperature or more, wherein when a fuel cut is prohibited by said fuel cut prohibiting means when the vehicle decelerates in a predetermined period after an increased fuel operation is performed for operating said internal combustion engine so that a combustion air-fuel ratio becomes rich, the internal combustion engine is operated so that the combustion air-fuel ratio becomes lean in said decelerating state or in said decelerating state and its succeeding idling state, wherein the greater the degree of deceleration in said decelerating state, the greater the degree of leanness of the combustion air-fuel ratio or the greater the amount of intake air when the engine is operated so that said combustion air-fuel ratio becomes lean.

4. A control device of an internal combustion engine provided with fuel cut executing means for executing a fuel cut for stopping the supply of fuel to an internal combustion engine mounted in a vehicle when said vehicle is in a decelerating state and fuel cut prohibiting means for prohibiting a fuel cut executed by said fuel cut executing means when a temperature of a catalyst provided in an exhaust system of said internal combustion engine is a predetermined temperature or more, wherein when a fuel cut is prohibited by said fuel cut prohibiting means when the vehicle decelerates in a predetermined period after an increased fuel operation is performed for operating said internal combustion engine so that a combustion air-fuel ratio becomes rich, the internal combustion engine is operated so that the combustion air-fuel ratio becomes lean in said decelerating state or in said decelerating state and its succeeding idling state, wherein an amount of intake air is increased when the engine is operated so that the combustion air-fuel ratio becomes lean more than when it is operated so that the combustion air-fuel ratio becomes the stoichiometric air-fuel ratio, and wherein said engine is operated so that said combustion air-fuel ratio becomes lean only when the speed of said vehicle is less than a predetermined vehicle speed.

5. A control device of an internal combustion engine provided with fuel cut executing means for executing a fuel cut for stopping the supply of fuel to an internal combustion engine mounted in a vehicle when said vehicle is in a decelerating state and fuel cut prohibiting means for prohibiting a fuel cut executed by said fuel cut executing means when a temperature of a catalyst provided in an exhaust system of said internal combustion engine is a predetermined temperature or more, wherein when a fuel cut is prohibited by said fuel cut prohibiting means when the vehicle decelerates in a predetermined period after an increased fuel operation is performed for operating said internal combustion engine so that a combustion air-fuel ratio becomes rich, the internal combustion engine is operated so that the combustion air-fuel ratio becomes lean in said decelerating state or in said decelerating state and its succeeding idling state, wherein an amount of intake air is increased when the engine is operated so that the combustion air-fuel ratio becomes lean more than when it is operated so that the combustion air-fuel ratio becomes the stoichiometric air-fuel ratio, and wherein an ignition timing is retarded when an amount of intake air is increased when the engine is operated so that the combustion air-fuel ratio becomes lean more than when it is operated so that the combustion air-fuel ratio becomes the stoichiometric air-fuel ratio.

6. A control device of an internal combustion engine provided with fuel cut executing means for executing a fuel cut for stopping the supply of fuel to an internal combustion engine mounted in a vehicle when said vehicle is in a decelerating state and fuel cut prohibiting means for prohibiting a fuel cut executed by said fuel cut executing means when a temperature of a catalyst provided in an exhaust system of said internal combustion engine is a predetermined temperature or more, wherein when a fuel cut is prohibited by said fuel cut prohibiting means when the vehicle decelerates in a predetermined period after an increased fuel operation is performed for operating said internal combustion engine so that a combustion air-fuel ratio becomes rich, the internal combustion engine is operated so that the combustion air-fuel ratio becomes lean in said decelerating state or in said decelerating state and its succeeding idling state, wherein said fuel cut prohibiting means does not prohibit a fuel cut when a degree of deceleration in a decelerating state of said vehicle is larger than a predetermined degree of deceleration.

7. A control device of an internal combustion engine provided with fuel cut executing means for executing a fuel cut for stopping the supply of fuel to an internal combustion engine mounted in a vehicle when said vehicle is in a decelerating state and fuel cut prohibiting means for prohibiting a fuel cut executed by said fuel cut executing means when a temperature of a catalyst provided in an exhaust system of said internal combustion engine is a predetermined temperature or more, wherein when a fuel cut is prohibited by said fuel cut prohibiting means when the vehicle decelerates in a predetermined period after an increased fuel operation is performed for operating said internal combustion engine so that a combustion air-fuel ratio becomes rich, the internal combustion engine is operated so that the combustion air-fuel ratio becomes lean in said decelerating state or in said decelerating state and its succeeding idling state, wherein operation of the engine is switched to operation so that the combustion air-fuel ratio becomes the stoichiometric air-fuel ratio when fluctuation of an engine speed becomes larger than a predetermined fluctuation of speed when the engine is operated so that said combustion air-fuel ratio becomes lean.

* * * * *